US005697109A

United States Patent [19]

Hodgetts

[11] Patent Number: 5,697,109

[45] Date of Patent: Dec. 16, 1997

[54] PATIENT TRANSPORT SYSTEM

[75] Inventor: Graham L. Hodgetts, Baden, Pa.

[73] Assignee: Barton Medical Corporation, Austin, Tex.

[21] Appl. No.: 440,065

[22] Filed: May 12, 1995

Related U.S. Application Data

[63] Continuation-in-part of Ser. No. 330,808, Oct. 28, 1994.

[51] Int. Cl.[6] ..... A61G 7/08

[52] U.S. Cl. ..... 5/81.1 R; 5/81.1 HS

[58] Field of Search ..... 5/81.1, 88.1, 81.1 C, 5/81.1 HS; 248/201, 266, 267, 251, 252; 211/60.1, 70.8, 64; 160/120, 121.1, 238, 291, 297, 323.1

[56] References Cited

U.S. PATENT DOCUMENTS

| | | | |
|---|---|---|---|
| 378,220 | 2/1888 | Staples et al. . | |
| 716,886 | 12/1902 | Goode . | |
| 1,263,611 | 4/1918 | Scroggin . | |
| 1,487,171 | 3/1924 | La Vigne . | |
| 2,093,231 | 9/1937 | Broadwell | 24/245 |
| 2,487,648 | 11/1949 | Green | 248/267 |
| 2,536,707 | 1/1951 | Allyn | 5/85 |
| 2,630,583 | 3/1953 | Gilleland | 5/81 |
| 2,632,619 | 3/1953 | Wilson | 248/201 |
| 2,733,452 | 2/1956 | Tanney | 5/81 |
| 2,745,163 | 5/1956 | Van Buren, Jr. | 24/246 |
| 2,939,195 | 6/1960 | Carlson | 24/245 |
| 3,140,069 | 7/1964 | McBurney et al. | 248/201 |
| 3,165,760 | 1/1965 | Abajian . | |
| 3,294,247 | 12/1966 | Norrington | 248/201 |
| 3,302,219 | 2/1967 | Harris | 5/85 |
| 3,413,663 | 12/1968 | Swann | 5/81 |
| 3,593,351 | 7/1971 | Dove | 5/81 |
| 3,709,556 | 1/1973 | Allard et al. | 297/188 |
| 3,769,642 | 11/1973 | Warman | 5/81 A |
| 3,775,784 | 12/1973 | Fry | 5/81.1 C |
| 3,794,313 | 2/1974 | Berger et al. | 269/322 |
| 3,810,263 | 5/1974 | Taylor et al. | 5/81 R |
| 3,848,784 | 11/1974 | Baxter | 211/60.1 |
| 4,068,770 | 1/1978 | Boehringer | 214/85 |
| 4,403,641 | 9/1983 | Reeder | 160/238 |
| 4,416,511 | 11/1983 | Weinberg | 160/238 |
| 4,679,259 | 7/1987 | DiMatteo et al. | 5/81.1 C |
| 4,681,279 | 7/1987 | Nakamura | 160/294 |
| 4,686,748 | 8/1987 | Kaivanto | 24/522 |
| 4,688,304 | 8/1987 | Marcott | 24/459 |
| 4,696,025 | 9/1987 | Taylor | 378/146 |
| 4,747,170 | 5/1988 | Knouse | 5/81 |
| 4,761,841 | 8/1988 | Larsen | 4/81 R |
| 4,776,047 | 10/1988 | DiMatteo | 5/81 R |
| 4,787,104 | 11/1988 | Grantham | 5/66 |
| 4,837,873 | 6/1989 | DiMatteo et al. | 5/81.1 C |
| 4,868,938 | 9/1989 | Knouse | 5/88.1 |
| 4,947,418 | 8/1990 | Barr et al. | 378/177 |
| 4,970,738 | 11/1990 | Cole | 5/81.13 |
| 5,022,810 | 6/1991 | Sherrow et al. | 414/501 |
| 5,033,132 | 7/1991 | Greenblatt | 160/238 |

(List continued on next page.)

*Primary Examiner*—Rodney M. Lindsey
*Assistant Examiner*—Tuyet-Phuong Pham
*Attorney, Agent, or Firm*—Webb Ziesenheim Bruening Logsdon Orkin & Hanson, P.C.

[57] ABSTRACT

A patient transport system for transporting a patient from a bed to a stretcher or vice versa, using a bed sheet and a conveyor attached to the bed or the stretcher. A first end of the sheet is removably attached to the conveyor and a second end of the sheet is free. The sheet is adapted to be positioned onto the patient supporting member of the bed or stretcher. The conveyor includes a roller received by bearings. The roller can be removably received by the bearings. The roller can also include a telescopic arrangement so that its length can be adjusted. A pawl and ratchet assembly can be provided on the conveyor to prevent unwinding of the conveyor. The sheet is removably attached to the roller by adhesive tape or a clip arrangement. A flexible belt attaches the clip to the conveyor and is removably secured to the roller. The clip includes a body member having a recess with a plug received therein.

47 Claims, 17 Drawing Sheets

U.S. PATENT DOCUMENTS

| | | | |
|---|---|---|---|
| 5,033,170 | 7/1991 | Ewert | 24/459 |
| 5,038,424 | 8/1991 | Carter et al. | 5/81.1 C |
| 5,152,486 | 10/1992 | Kabanek et al. | 248/201 |
| 5,163,189 | 11/1992 | DeGray | 5/86.1 |
| 5,213,580 | 5/1993 | Slepian et al. | 623/1 |
| 5,236,390 | 8/1993 | Young | 454/95 |
| 5,279,010 | 1/1994 | Ferrand et al. | 5/600 |
| 5,340,266 | 8/1994 | Hodgetts | 414/527 |
| 5,353,453 | 10/1994 | Naumann | 5/417 |
| 5,435,323 | 7/1995 | Rudy | 5/628 |

PATIENT TRANSPORT SYSTEM

CROSS REFERENCE TO RELATED APPLICATION

This application is a continuation-in-part of U.S. application Ser. No. 08/330,808, filed Oct. 28, 1994 and entitled "Patient Transport System".

BACKGROUND OF THE INVENTION

1. Field of the Invention

This invention relates to patient transport systems, and more particularly, to a patient transport system for transferring an immobile patient from a bed to a gurney or vice versa.

2. Description of the Prior Art

It appears to be widely accepted that a major, if not the major, work-related complaint among nurses and hospital nursing staff is back injuries caused by lifting patients and getting them in and out of a bed and to and from a gurney or a stretcher as it is commonly referred to. A survey of existing practices and techniques suggests that there is no widely adopted simple and safe method of transferring patients from a bed to a gurney, or vice versa, without lifting them. There are hoist-type lifts where the patient is suspended in a sling. The sling must be first manipulated under the patient and then the patient must be physically lifted, changing the shape of the body and applying pressures different from those existing on the patient when lying prone in bed. There are also roller boards which are inserted partially under the patient and then the patient is pulled onto the roller board. Again, the patient must be manipulated to allow the board to be inserted and then the body is pulled onto the board. In the end, the patient ends up on the board, not on the gurney or the bed. An additional disadvantage of the roller board is that either the patient must cooperate with the transferrer or more than one transferrer is required to effect the transfer. Patients have also been known to drop off the roller boards and to land on the floor between the bed and the gurney.

An earlier patent application, U.S. patent application Ser. No. 08/330,808, which is hereby incorporated by reference, solves this age-old problem of transferring patients from a bed or a gurney and vice versa. That patent application discloses an apparatus for transporting a patient and includes a base, a patient supporting member attached to the base, a conveyor attached to the base and a removable sheet. The sheet has a first end and a second end where the sheet first end is removably attached to the conveyor and the sheet second end is free. The sheet is adapted to be positioned on the patient supporting member, such as a mattress. In operation, an end of the sheet, which is attached to the conveyor, is rotated around a roller thereby moving the patient from the bed to a gurney or vice versa.

However, the conveyor disclosed in U.S. patent application Ser. No. 08/330,808 requires that the roller remain affixed to the bed or gurney, or the complete conveyor be removed from the bed or gurney. This results in a problem of storing the conveyor in a hospital room and transporting the conveyor when it is not attached to the bed or gurney.

Further, typically hospital beds vary in length and in many cases can be adjusted so that their lengths vary. In this case, a conveyor, such as that disclosed in U.S. patent application Ser. No. 08/330,808, may be inoperative if the length of the roller is different from that of the length of the bed. Further, if the length of the bed is varied during operation, then such a fixed length roller could affect the operation of the bed.

Therefore, it is an object of my invention to allow a patient, while lying in a prone position and completely immobile, to be moved, by one person of relatively low strength, safely from the bed to the gurney and vice versa, and to accommodate various bed lengths with one conveying apparatus.

It is also an object of my invention to provide a patient transport system for a bed or a gurney which can be easily engaged with the bed or gurney and removed.

SUMMARY OF THE INVENTION

My invention is an apparatus for transporting a patient that includes a base, a patient supporting member attached to the base, a conveyor removably secured to the base, and a sheet. The sheet has a first end and a second end, where the first end is attached to the conveyor. The sheet is adapted to be positioned onto the patient supporting member. The base and the patient supporting member can form a bed, a gurney or an apparatus that converts from a gurney to a wheelchair or vice versa.

The conveyor includes a roller rotatably secured to the base, where the roller can be made of graphite fibers, aluminum, fiberglass or steel. The roller includes a first end and a second end. The sheet first end is attached to the roller and two bearings which are removably and rotatably secured to respective first and second ends of the roller.

Each bearing includes a first leg and a second leg attached to the first leg. The first and second legs define an open ended roller receiving recess that receives an end of the roller. A tip extends from one of the legs into the roller recess. Preferably, the tip extends from the first leg, which includes an inner surface having a first section and a second section, where the tip extends at an interface of the two sections. The second leg includes a first segment and a depending second segment. The second segment is secured to the first leg. Inner surfaces of the first segment, second segment and second section define a roller engaging recess. The second section inner surface is concave shaped.

A pair of collars are provided on both ends of the roller, wherein the bearings are received between the collars.

The sheet is removably attached to the conveyor by a flexible strap having one end releasably attached to the roller and the other end releasably attached to the sheet. Preferably, a clip is releasably secured at one end of the strap for attaching to the sheet. The length of the strap can be adjusted. Preferably, Velcro® fasteners are provided on an end of the strap and along the length of the roller so the strap can be releasably secured to the roller.

The roller can be provided with a telescopic arrangement so that its length can be adjusted, wherein the roller includes a first longitudinally extending member that slidably receives a second longitudinally extending member with a recess defined in the first longitudinally extending member. Preferably, the recess has the same geometric shape as a cross-sectional shape of the second longitudinal member. A segmented handle can be attached to the roller. An annular member is slidably received by the second longitudinally extending member and a flexible strip. is secured to the annular member.

A tube can be attached to the base and a post can be attached to the bearing, or vice versa. The post is slidably received by the tube so that the bearing is removably secured to the base. A pawl and ratchet arrangement can be secured to the roller and bearing to prevent the roller from rotating in a defined direction.

My invention can be used on a bed, a gurney or a convertible gurney that converts from a gurney to a wheelchair.

My invention is also a method for transporting a patient from a bed to a gurney or vice versa using the above-described conveyor including the steps of: placing a sheet on one of the mattress of the bed and the patient supporting surface of the gurney, positioning the patient. on the sheet, attaching the conveyor to the other of the bed and the gurney having the sheet, positioning the gurney adjacent to the bed so that the conveyor is along a side of the other of the gurney and the bed, the side being furthest away from the one of the bed and the gurney having the sheet, removably attaching the sheet to the roller, rotating the roller and thereby winding the sheet around the roller, moving the patient on the sheet from the one of the bed and gurney toward the roller onto the other of the bed and the roller, and removing the roller from the one of the bed and the gurney.

The method can also include the steps of attaching the sheet to straps secured to the roller and adjusting the length of the straps after the patient begins to be moved on the sheet so that all of the straps are taut.

DESCRIPTION OF THE PREFERRED EMBODIMENTS

Figure 1:
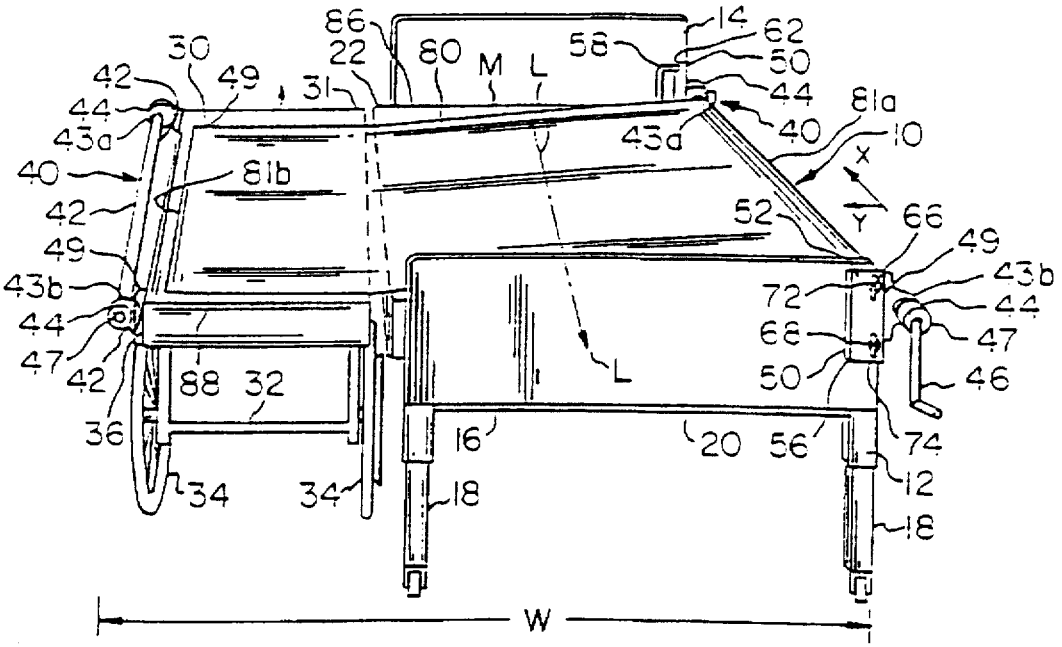
FIG. 1 is a perspective view of a gurney, a hospital bed and a conveyor.

Referring to FIGS. 1–9, there is shown a bed and a gurney having a conveyor in accordance with the present invention disclosed in U.S. patent application Ser. No. 08/330,808 of which I am a co-inventor. Specifically, FIG. 1 shows a bed 10 that includes a bed frame or base 12 having a headboard 14, a baseboard 16, legs 18 attached to headboard 14 and baseboard 16, and a mattress supporting frame 20 attached to headboard 14 and baseboard 16 and legs 18. A mattress 22 is supported by mattress supporting frame 20. A gurney or stretcher 30, which is positioned directly adjacent to a side 31 of mattress 20 of bed 10, includes a frame or base 32 having wheels 34 attached thereto (throughout the specification, gurney and stretcher are used interchangeably). A patient supporting member 36 is supported by frame 32. Both mattress 20 and patient supporting member 36 extend in a first longitudinal direction shown by the arrow X.

As can be seen in FIG. 1, both bed 10 and gurney 30 have a conveyor 40 attached thereto. Each conveyor 40 includes a roller 42 having two ends or end portions 43*a* and 43*b*. Each end portion 43*a* and 43*b* is rotatably received by or rotatably coupled to a respective bearing unit 44. Thus, bearing units 44 are positioned near opposite ends of roller 42. A removable handle 46 or rotating member is received by a coupling 47 attached to end 43*b* of roller 42. Each bearing unit 44 includes a low friction bearing member, such as the Fafnir R.P.B. bearing and a housing 48. Roller 42, bearing unit 44, handle 46, and coupling 47 are similar to those used in Loadhandler Industries, Inc. LH-1000 Unloader described in U.S. Pat. No. 5,340,266 and PCT application Ser. No. US94/07816, which are hereby incorporated by reference. Each housing 48 includes an attaching member plate 49. Plate 49 attaches to gurney 30 or bed 10 either by welding plate 49 to gurney frame 32 or bed frame 12, or by fastening plate 49 to gurney frame 32 or bed frame 12, through fasteners, such as screws.

Figure 2:
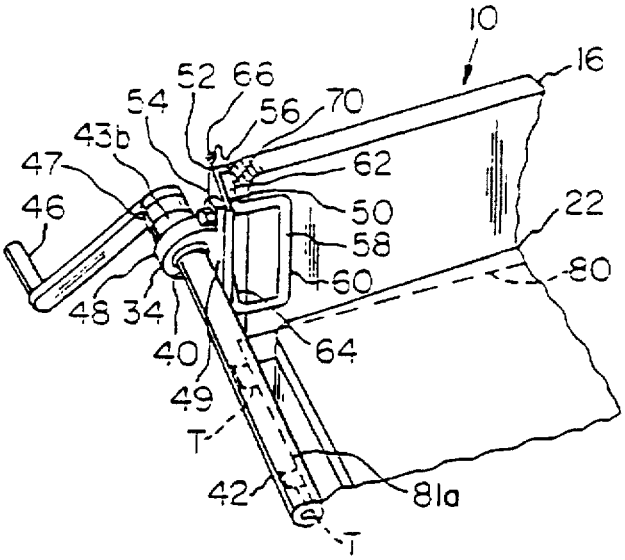
FIG. 2 is a partial top view of a portion of the bed and the conveyor shown in FIG. 1.
Figure 15:
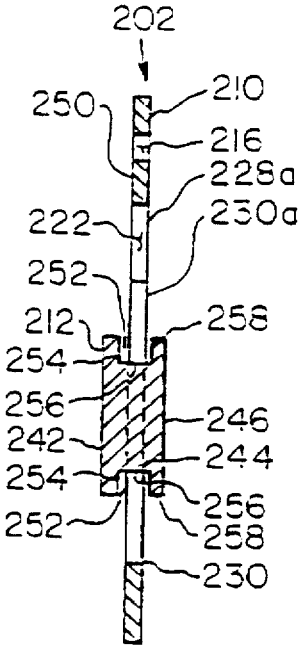
FIG. 15 is a sectional view of the body member and plug member.

Alternatively, each plate 49 can be attached to or coupled to a conveyor attaching member 50. Each member 50 includes an L-shaped plate 52 having a first leg 54 and a second leg 56 extending therefrom. A second member 58 is provided having a U-shaped portion 60. Two legs 62 and 64 depend from U-shaped portion 60. Preferably, member 58 is formed by bending a metallic rod having a circular cross-section. Legs 62 and 64 have threaded ends 66 and 68, respectively. Two holes are defined in leg 56 of L-shaped plate 52 through which legs 62 and 64 pass, respectively. A recess 70 is defined between L-shaped plate 52 and second member 58. member 58. Either headboard 14 or baseboard 16 of bed 10 is positioned within recess 70, as shown in FIGS. 1 and 2.

Conveyor 40 attaches to or is coupled to bed 10 as follows. First, second leg 56 of L-shaped plate 52 and U-shaped portion 60 of second member 58, which are secured to one of bearing units 44, are pressed against respective sides of headboard 14. Then, second leg 56 and U-shaped portion 60 are held in place by wing nuts 72 and 74, which are threadably received by respective threaded ends 66 and 68 of legs 62 and 64 and abut against respective second legs 56. Wing nuts 72 and 74 are tightened sufficiently to hold, through frictional forces, attaching member 50 to headboard 14. The same process is then repeated for second leg 56 and U-shaped portion 60 of the other bearing unit 44, which is secured to baseboard 16, thereby holding conveyor 40 in place.

A sheet 80, such as a bedsheet, is releasably attached to roller 42. Preferably, sheet 80 is at least. two times the width W of bed 10 and gurney 30, when bed 10 and gurney 30 are positioned adjacent one another, as shown in FIG. 1. An end 81*a* of sheet 80 is releasably attached to roller 42 with adhesive tape T, shown in phantom, such as cloth backed first aid tape or duct tape. Opposite end of sheet 81*b* is unsecured and is a free end. Preferably, sheet 80 is made from high quality fabric, such as cotton or polyester, with at least 180 threads per inch weave construction, although any type of sheeting material which can support a body can be used. A queen size bed sheet works satisfactory for use with a twin size mattress. Conveyor 40 is adapted to move sheet 80, and in turn a patient 100, in a second longitudinal direction shown by arrow Y, which is transverse to the first longitudinal direction shown by the arrow X.

Moving patient 100 using conveyor 40 is described hereinbelow.

a) Moving a Patient from the Bed to the Gurney

Figure 3:
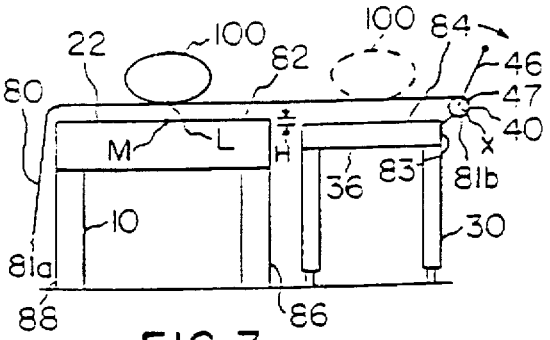
FIG. 3 is a schematic side view of a bed, a gurney and a conveyor attached to the gurney for moving a patient from the bed to the gurney.

As shown in FIG. 3, initially patient 100 is lying in a prone position on bed 10 preferably on or near longitudinal centerline L of sheet 80. Typically, sheet 80 is secured to bed 10 by tucking sheet 80 under mattress 20. Sheet 80 is then untucked or unsecured from bed 10 and an edge 81*b* of sheet 80 closest to gurney 30 is extended across gurney 30. Conveyor 40 is attached to gurney 30 at a side 83 of gurney 30 furthest from bed 10. Edge 81*b* of sheet 80 is releasably attached to roller 42 using, for example, adhesive tape. Preferably, bed 10 and gurney 30 are adjusted so that an upper surface 82 of mattress 20 is approximately two inches higher H than an upper surface 84 of patient supporting member 36. Height adjusting mechanisms for hospital beds and gurneys are well known in the art. Roller 42 is then slowly rotated about a longitudinal axis X passing through roller 42, so that preferably at least two complete wraps of sheet 80 are wound onto roller 42. Handle 46 is then inserted into or attached to coupling 47 of conveyor 40. Roller 42 is then rotated about longitudinal axis X, so that sheet 80 continues to be wound onto roller 42. This causes sheet 80 with patient 100 lying on an upper surface thereof to slide across upper surface 82 of mattress 10 and upper surface 84 of gurney supporting member 36, thereby causing patient 100 to be moved from bed 10 to gurney 30, as shown in phantom in FIG. 3. Any remaining part of sheet 80 on bed 10 after patient 100 is transferred, to gurney 30 can be placed over patient 100. Patient 100 can then be transported by gurney 30.

b) Moving a Patient from the Gurney to the Bed

Figure 4:
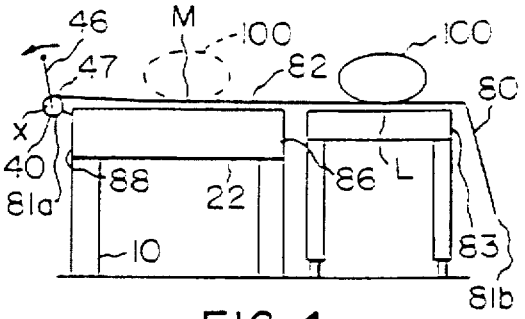
FIG. 4 is a schematic view of a bed, gurney and a conveyor attached to the bed for moving a patient from the gurney to the bed.
Figure 5:
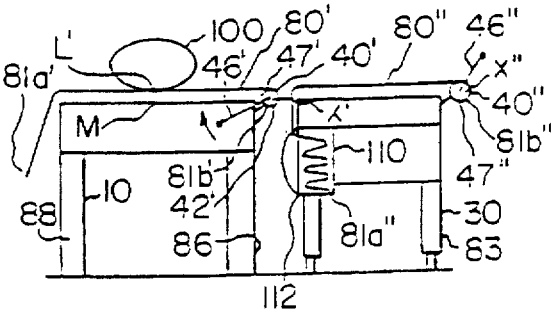
FIGS. 5–9 are schematic views showing a bed, a gurney and a conveyor for moving a patient to and from the bed and the gurney for the purposes of changing a bed sheet on the bed.
Figure 6:
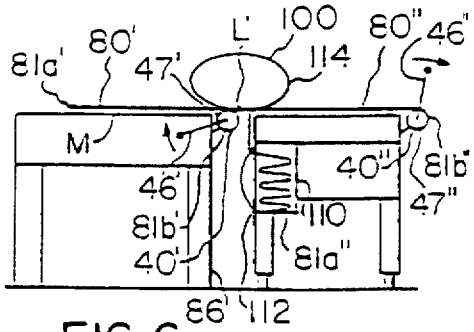
Figure 7:
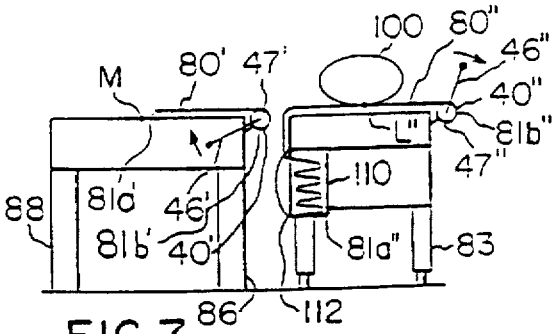

As shown in FIG. 4, initially patient 100 is lying in a prone position on gurney 30. Specifically, the patient is lying on or near longitudinal centerline L of sheet 80 resting on upper surface 84 of patient supporting member 36. Gurney 30 is positioned along a side 86 of bed 10. Conveyor 40 is attached to bed 10 on side 88 of bed 10 furthest from gurney 30. Edge 81*a* of sheet 80 closest to bed 10 is removably attached to roller 42 with, for example, four or five short pieces of adhesive tape as previously described. Preferably, bed 10 and gurney 30 are adjusted so that upper surface 82 of mattress 20 is approximately two inches above upper surface 84 of patient supporting member 36. Roller 42 is then slowly rotated about longitudinal axis X so that preferably at least two complete wraps of sheet 80 are wound onto roller 42. Handle 46 is then inserted into or attached to coupling 47 of conveyor 40 and roller 42 is rotated about the longitudinal axis X so that sheet 80 continues to be wound onto roller 42. This causes patient 100 to be moved from gurney 30 onto bed 10 in a manner similar to moving patient. 100 from bed 10 to gurney 30. Roller 42 is rotated until the patient is located in a middle section M of bed 10. Sheet 80 is then removed from roller 42 by removing the adhesive tape and can be secured to bed 10 by tucking sheet 80 under mattress 20. Conveyor 40 may then be removed from bed 10.

c) Changing Sheets on a Bed of a Prone, Immobile Patient Without Lifting or Manipulating the Patient FIGS. 5–9 show a method for changing sheets on bed 10 of a prone, immobile patient without lifting or manipulating the patient. At least two conveyors 40 are required and are designated 40' and 40". A first conveyor 40' attaches to side 86 of bed 10 and a second conveyor 40" attaches to side 83 of gurney 30 as shown in FIG. 5. Conveyors 40' and 40" are the same as conveyor 40 previously described. Initially, patient 100 is on bed sheet 80 on bed 10, lying essentially on longitudinal centerline L' on sheet 80'. Sheet 80', which is positioned under patient 100, is unsecured or untucked and removably attached at longitudinal edge 81*b*' with adhesive tape, or another type of removable fastener, to roller 42'. Then roller 42' is turned slowly by hand so that preferably at least two wraps of sheet 80' are wound around roller 42'. A fresh sheet 80" is then laid across patient supporting member 36 of gurney 30. Longitudinal edge 81b' of sheet 80" is attached with adhesive tape to roller 42". Then roller 42" is turned slowly by hand so that preferably at least two wraps of sheet 80" are wound around roller 42". Loose end 81a" of fresh sheet 80" is gathered and folded concertina style and laid in a sheet retaining receptacle 110, as shown in FIGS. 5–9, positioned underneath a longitudinal edge 112 of gurney 30. Edge 112 of gurney 30 is positioned adjacent side 86 of bed 10 and conveyor 40' so that conveyor 40' is positioned between bed 10 and gurney 30, and conveyor 40" of gurney 30 is positioned on the side of gurney 30 furthest from bed 10. Preferably, bed 10 and gurney 30 are adjusted so that upper surface 82 of mattress 20 is about two inches above upper surface 84 of patient supporting member 36 and an upper horizontal tangent of roller 42' should be approximately one inch below surface 82. Preferably, gurney 30 is then clamped to bed 10 using any sort of clamping device, for example, a C-clamp, although locking the wheels of gurney 30 will also suffice. Handle 46' is then inserted into or attached to coupling 47' of conveyor 40' and turned, moving patient 100 toward gurney 30, until a shoulder of patient 100 is positioned over gurney 30 and starts to push fresh sheet 80" across gurney 30 toward side 83, as shown in FIG. 6. Second handle 46" is then inserted into or attached to coupling 47" of conveyor 40". Handle 46" should then be rotated about a longitudinal axis X" moving fresh sheet 80" and patient 100 onto gurney 30, as shown in FIG. 7. Preferably, handle 46' should continue to be rotated while handle 46" is rotated.

Figure 8:
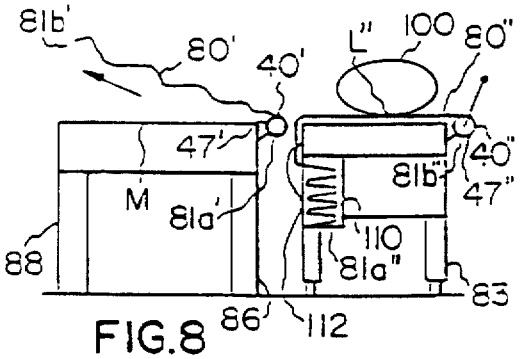
Figure 9:
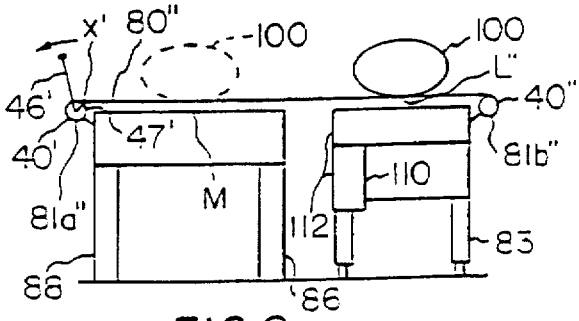

Once patient 100 is on gurney 30, rotation of handles 46' and 46" is stopped and sheet 80" is removed from bed 10 and conveyor 40' by grasping free edge 81b' of sheet 80' lying on bed 10 and pulling it off roller 42', as shown in FIG. 8. Conveyor 40' is then moved and attached to side 88 of bed 10, i.e., to the side furthest away from gurney 30, as shown in FIG. 9. Free edge 81a" of sheet 80" is extended across mattress 20 of bed 10 and removably attached to roller 42'. Handle 46' is then attached or inserted into coupling 47' of conveyor 40' and rotated about the longitudinal axis X', as previously discussed, thereby wrapping sheet 80" around roller 42'. Patient 100 is then moved by sheet 80", which is moved by conveyor 40', from gurney 30 onto bed 10 and is now lying on fresh sheet 80". Sheet 80" is then removed from rollers 42' and 42" and can be tucked under mattress 20 in an appropriate fashion. Sheet 80" can also be removed from roller 42" prior to its being wound around roller 42'. Conveyors 40' and 40" may then be removed from bed 10 and/or gurney 30.

It should be noted that conveyor 40 can include a motor in lieu of a handle to rotate roller 42. Further, conveyor 40 described above can be permanently affixed to bed 10 or gurney 30 and one or two conveyors may be attached to bed 10 and/or gurney 30. This depends on whether a conveyor 40 is attached to one side or both sides of bed 10 or gurney 30.

Conveyor 40 and the above-described methods for moving a patient from gurney 30 to bed 10 solve several problems in moving immobile patients. First, conveyor 40 is inexpensive to manufacture and simple to operate, and overcomes many of the problems involved in the complex conveying mechanisms presently known in the art. Further, conveyor 40 utilizes a bed sheet 80 which is then used on the bed. This eliminates the need to move the patient by lifting the patient from gurney 30 to bed 10 or vice versa. Further, the patient need not be physically lifted by a nurse's aid or nurse because the patient is transported by the sheet. This will minimize injuries to nurses, nurse's aides and patients in moving a patient from gurney 30 to bed 10 or vice versa. Furthermore, only one person is required to move the patient between gurney 30 and bed 10. This will result in a substantial labor cost savings associated with transferring patients.

A second embodiment of conveyor 40, as described in U.S. patent application Ser. No. 08/330,808 and identified as conveyor 200, is shown in FIGS. 10–20. Conveyor 200 is similar to conveyor 40 except conveyor 200 includes a clip 202. Like reference numerals are used for like parts.

Figure 10:
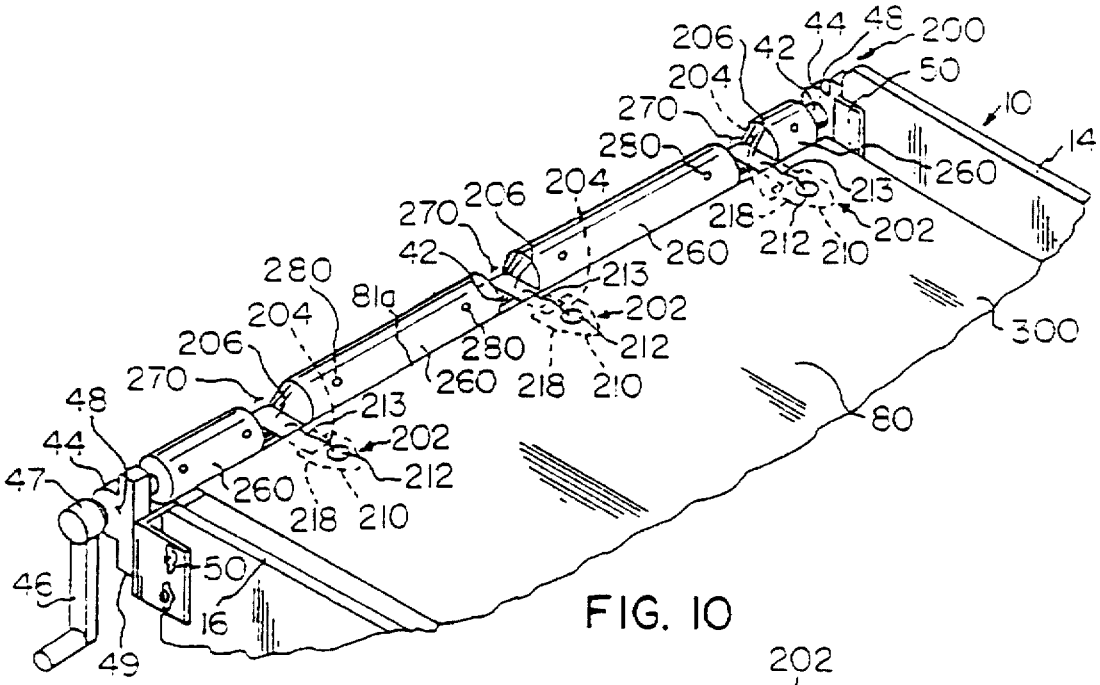
FIG. 10 shows a partial perspective view of a bed and a conveyor having a belt and a clip.

As shown in FIG. 10, conveyor 200 includes a roller 42, bearing units 44, and a removable handle 46 received by a coupling 47. Each bearing unit includes a low friction bearing and housing 48, which includes an attaching member plate 49. Each plate 49 can be attached. to a conveyor attaching member 50.

Three fasteners or clips 202 are attached to roller 42. Specifically, each clip 202 is attached to an end 204 of a respective flexible belt 206. An opposite end 208 of belt 206 is attached to roller 42. Preferably, three or four belts 206 are spaced along roller 42. Belts 206 are permanently attached to roller 42, either by an adhesive or by mechanical fasteners. Belts 206 are made of a flexible material such as woven polypropylene, woven polyethylene or cotton. Belts 206 should be at least as long as the sheet being replaced, say three to four feet for a twin size bed.

As shown in FIGS. 10–16, each clip 202 includes a substantially flat body member 210 and a plug member 212. Preferably, plug member 212 is attached to belt 206 by a flexible string 213 to prevent plug member 212 from being misplaced (See FIG. 10). Body member 210 includes a first section 214 defining a belt receiving slot 216. Belt end 204 passes through slot 216 and is sewn to a section 218 of belt 206 to attach clip body member 210 to belt 206 (See FIG. 16). Alternatively, Velcro® fasteners can be provided on belt end 208 and belt section 218 so they can be releasably secured to each other. Using the Velcro® fastener permits adjustment of the length of belt 206.

Figure 12:
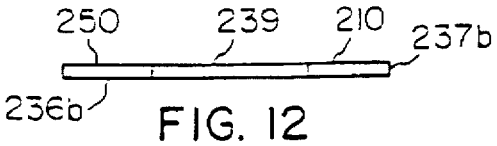
FIG. 12 is a front view of the clip body member shown in FIG. 11.
Figure 11:
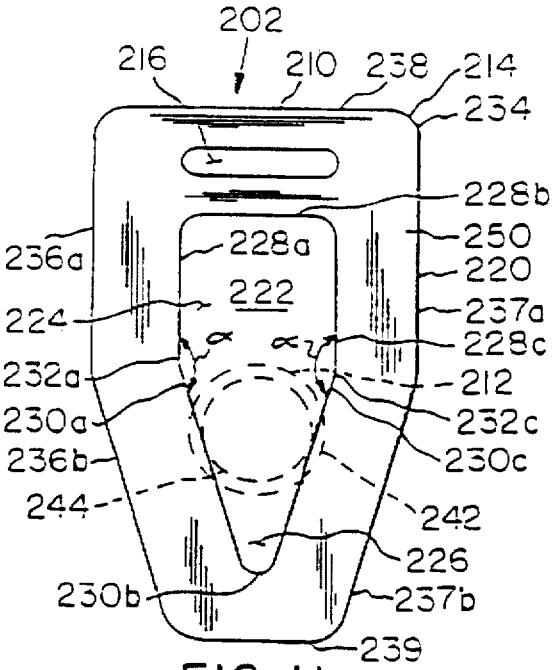
FIG. 11 is a top view of a clip body member.
Figure 16:
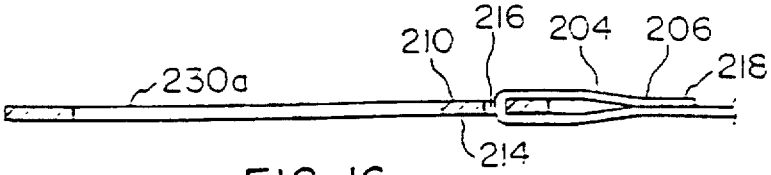
FIG. 16 is a sectional view of the body member and a belt.
Figure 17:
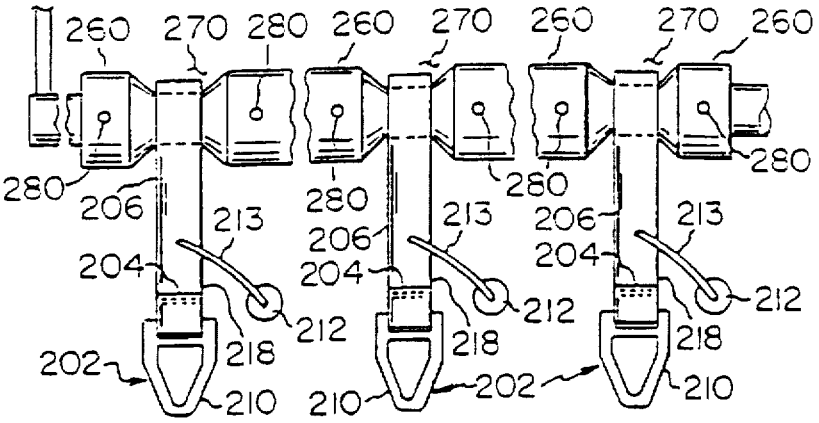
FIG. 17 is a top view of a portion of the conveyor shown in FIG. 10.
Figure 18:
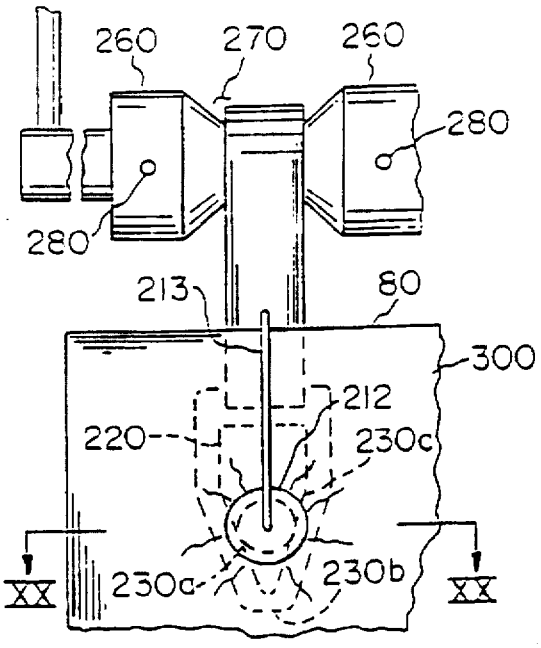
FIG. 18 is a top view of a portion of the conveyor shown in FIG. 10 with a sheet attached thereto.
Figure 19:
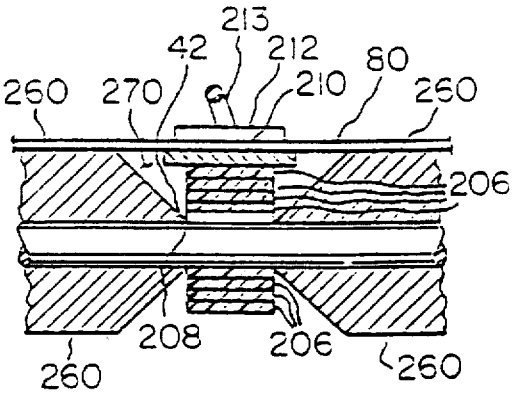
FIG. 19 is a partial sectional view of the conveyor shown in FIG. 10 with the belt partially wrapped around the conveyor.
Figure 20:
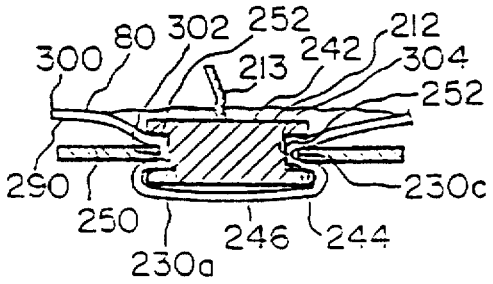
FIG. 20 is a section taken along line XX—XX of FIG. 18.

As shown in FIGS. 11 and 12, body member 210 includes a second section 220 defining a plug member receiving slot 222. Slot 222 includes a rectangular shaped section 224 and a converging or triangular shaped section 226. Rectangular shaped section 224 is defined by three edges 228a, 228b and 228c. Edges 228a and 228c have a length $A_1$ and edge 228b has a length $A_2$. Triangular shaped section 226 includes three edges 230a, 230b and 230c. Edges 230a and 230c intersect edges 228a and 228c at intersection points 232a and 232c, wherein edges 228a and 228c and edges 230a and 230c are spaced apart a distance $A_2'$, which in this case is equal to $A_2$. Edge 230b has a length $A_3$. Edges 230a and 230c converge toward edge 230b. An angle $\alpha$ is defined by edges 230a, 230c and 228a, 228c, respectively, at points 232a and 232c. Body member 210 has an outer edge 234 including first sides 236a, 236b; second sides 237a, 237b; first end 238 and second end 239 having lengths $A_4$, $A_5$, $A_6$, $A_7$, $A_8$ and $A_9$, respectively. Preferably, body member 210 is made from high density polyethylene, ultra high molecular weight polyethylene, such as Solidor® by Phillips Petroleum, polypropylene or polyolefin, which is flexible and yet sufficiently strong so as not to fail when used.

Body member 210 can be fabricated or molded. An actual body member has been fabricated wherein length $A_1$ is 1.25 inches, length $A_2$ is 1.5 inches, length $A_3$ is 0.5 inches and angle $\alpha$ is 165°. Body member 212 was made of high density polyethylene having a thickness of 0.125 inches. Lengths $A_4$–$A_9$ are approximately 2.25 inches, 2.5 inches, 2.25 inches, 2.5 inches, 3 inches and 1.5 inches. Slot 216 has dimensions of approximately 1.5 inches and 0.25 inches wide.

Figure 14:
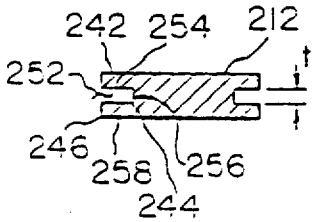
FIG. 14 is a section taken along line XIV—XIV of FIG. 13.
Figure 13:
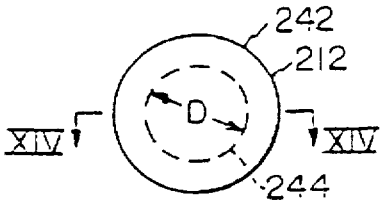
FIG. 13 is a top view of a clip plug member.

As shown in FIGS. 13 and 14, plug member 212 includes three circular shaped discs or members 242, 244 and 246, wherein disc 244 is sandwiched between and secured to discs 242 and 246. Disc 244 has a geometric diameter D, which is less than the diameter of discs 242 and 246. The diameter of disc 244 is less than $A_2'$, but greater than length $A_3$. Preferably, discs 242 and 246 have the same diameter, which is less than or equal to $A_1$ or $A_2$, so that plug 212 can pass through rectangular shaped section 224. Alternatively, disc 242 can have a diameter greater than length $A_2$ and rests on an upper surface 250 of body member 212, so that discs 244 and 246 can pass only through section 224. The thickness "t" of disc 244, and in turn, the spacing between discs 242 and 246 preferably are the same or slightly greater than the thickness of body member 210 (See FIG. 15). A body member receiving recess 252 is defined by surfaces 254, 256 and 258 of discs 242, 244 and 246, respectively. Preferably, plug 240 should be made of rubber and molded in one piece, such as EPDM rubber, having a Shore hardness on the A scale of 60–70.

An actual plug 240 has been made wherein discs 242 and 246 each have a diameter of 1.5 inches and disc 244 has a diameter of 0.75 inches and a thickness of 0.125 inches.

Conveyor 200 also includes a plurality of sleeves 260 secured to roller 42, as shown in FIGS. 10 and 17–19. Sleeves 260 are substantially hollow cylindrical members that slide over roller 42 and are positioned apart a distance slightly greater than the width of belts 206, so as to define a belt receiving recess 270 (See FIGS. 17–19). Sleeves 260 are attached to roller 42 by set screws 280. By use of belts 206 of sufficient length, say 3–4 feet, a standard size bed sheet can be used in lieu of an oversized bed sheet as previously discussed, i.e., a twin size standard bed sheet for a twin size bed mattress as opposed to a queen size bed sheet for a twin size bed mattress.

The above-described methods for transferring a patient are the same when using either the clip 202 or tape T, except that rather than taping sheet 80, 80' or 80" to roller 42, sheet 80, 80' or 80" is clipped to roller 42 as explained below. First, in the case of moving a patient from bed 10 to gurney 30, sheet 80, for example, is untucked. Each belt 206 is extended so that an underside 290 of sheet 80 rests on upper surface 250 of body member 210 (See FIGS. 10, 18 and 20). Plug member 212 is then placed on an upper surface 300 of sheet 80 directly over rectangular section recess 220. Each respective plug member 212 is then pressed against sheet 80 and moved towards edge **230*b* until edges 230*a* and 230*c* are received in recess 252. Plug member 212 is further moved toward end 230*b* until sheet 80 is bound and sandwiched between discs 242, 244, 246 and portions of edges 230*a*, 230*c* at interfaces 302 and 304 so that plug member 212 coacts with portions of edges 230*a* and 230*b* to releasably attach sheet 80 to conveyor 40 (See FIG. 20**).

Roller 42 is then rotated as previously discussed. Belts 206 are wound on roller 42 and are received in respective recesses 270 with sleeves 260 acting as guides for belts 206. This in turn causes sheet 80 to be pulled toward roller 42 by clips 202 and belts 206. Continued rotation of roller 42 forces each plug member 212 to move toward a respective edge **230*b*, thereby firmly securing sheet 80 to the respective clip 202. Continued rotation of roller 42 causes belts 206 and clips 202 to be wound onto roller 42. Preferably, clips 202 are flexible enough to wrap around roller 42. Continued rotation of roller 42 causes sheet 80 to wrap around roller 42 (See FIG. 19). This causes patient 100 to be moved by sheet 80 from bed 10 to gurney 30 as previously discussed. To remove sheet 80 from roller 42, roller 42 is unwound until clips 202 are exposed. Each plug member 212 is moved toward the respective edge 228*b*, so that plug member 212 unbinds sheet 80. Each plug member 212 is removed from slot 222 and away from sheet 80, so that each clip 202 disengages from sheet 80. Hence, clips 202 releasably attach sheet 80 to conveyor 40. Clip 202** can be used in lieu of tape T for any of the described methods.

Clip 202 can also be used for securing other sheet material or membranes, such as boat covers, carcovers, flexible covers or tarpaulins.

Figure 21:
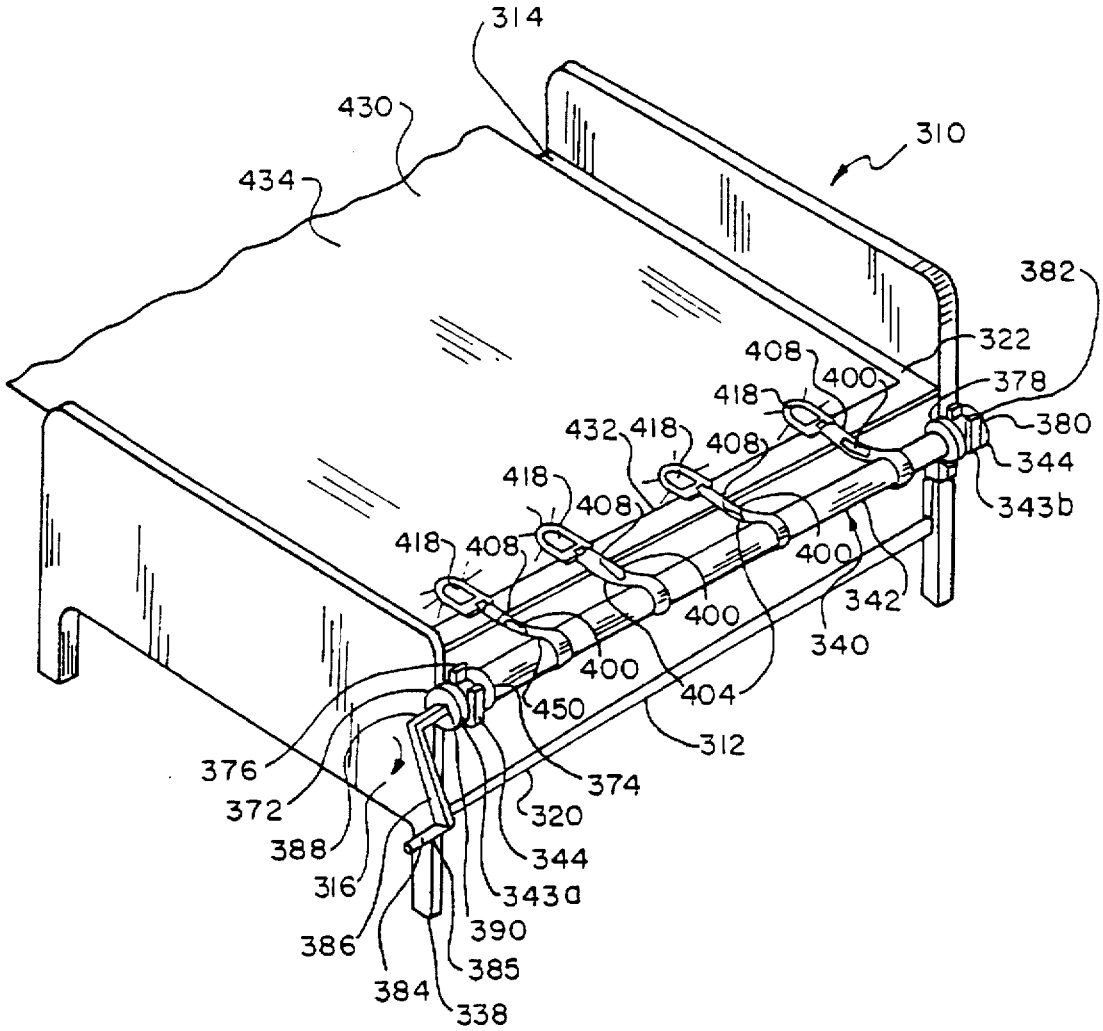
FIG. 21 is a perspective view of a hospital bed and a conveyor made in accordance with the present invention.

Referring to FIG. 21 of the drawings, there is shown a bed 310 (which is similar to bed 10) having a conveyor made in accordance with the present invention. Bed 310 includes a bed frame base 312 having a headboard, a baseboard, legs and a mattress supporting frame. A mattress 314 is supported by the mattress supporting frame.

Figure 22:
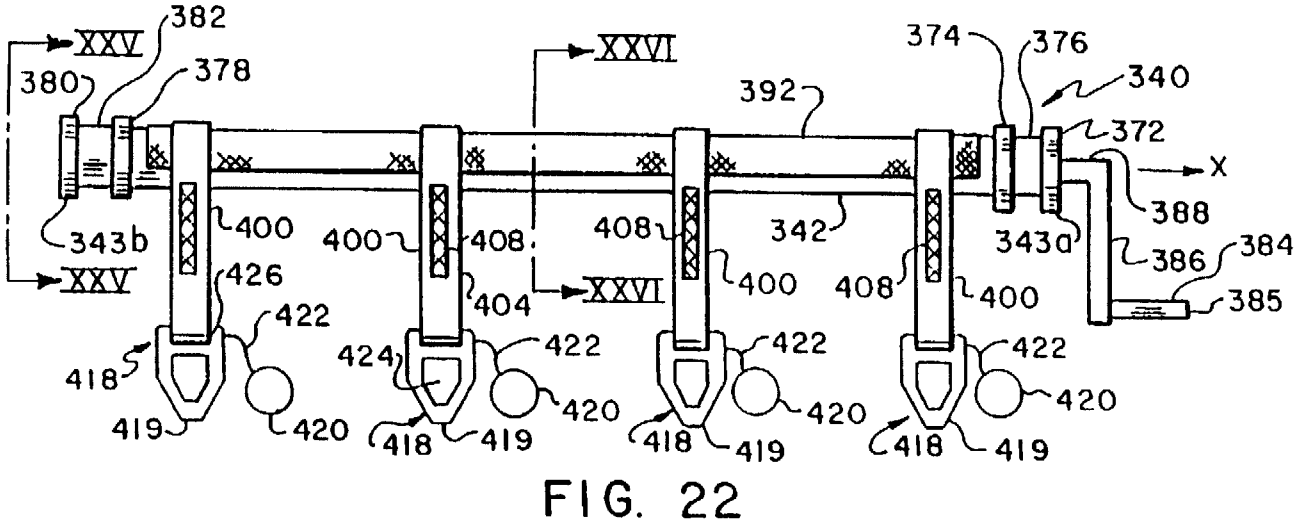
FIG. 22 is a plan view of a roller assembly of the conveyor shown in FIG. 21.
Figure 23:
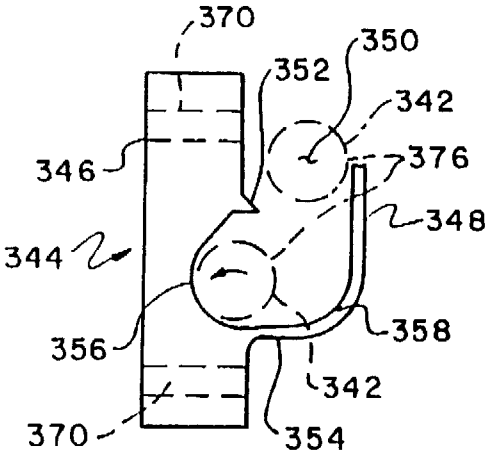
FIG. 23 is a side view of a bearing of the conveyor shown in FIG. 21.

As shown in FIGS. 21 and 22 of the drawings, a conveyor 340 attaches to bed 310. Conveyor 340 can be used in lieu of the previously described conveyors 40 and 200 to transport patients. The conveyor 340 includes a roller 342 having two ends or end portions **343*a* and 343*b*. Each end portions 343*a* and 343*b* is rotatably received or rotatably coupled to a respective bearing unit 344. As shown in FIG. 23 of the drawings, each bearing unit 344 includes a first leg 346 and a second L-shaped leg 348 integrally attached thereto, which defines an upwardly facing, open-ended slot 350 for receiving end portions 343*a* and 343*b* of roller 342. A tab 352 protrudes or extends from leg 346 dividing leg 346 into two sections. A locking recess 354 is defined by a C-shaped surface 356 defined in leg 348 and a portion of an inner surface 358 of leg 348. A lower end of the tab 352 defines an upper portion of the C-shaped surface 356. Preferably, bearing unit 344 is made out of a polymer material, such as high density polyethylene or ultra high molecular weight polyethylene. Preferably, each bearing unit 344 is secured to the bed by fasteners which pass through holes 370 defined in leg 346 or in any other manner. Although not shown, a similar bearing unit 344** can be attached to a gurney.

Roller 342 is substantially cylindrical in shape and extends substantially along the length of the bed 310. Preferably, the roller 342 is made of lightweight material, such as aluminum, plastic or other polymeric material, a graphite fiber material or a fiberglass material. Also, the roller 342 can be made of other metals, such as steel. The graphite fiber material can be pulltruded (i.e., the graphite fiber resin composition is pulled or drawn through an extrusion or forming die, which is well known in the art). The roller 342 includes two spaced apart collar members 372 and 374 at the first end **343*a*. A journal portion 376 is defined between collar members 372 and 374. Two spaced apart collar members 378 and 380 are provided at the second end 343*b* of the roller 342. A journal portion 382 is defined between collar members 372 and 374. Journal portions 376 and 382 are removably received by respective bearing units 344. Specifically, journal portions 376 and 382 are positioned within the locking recesses 354 and are adapted to abut against respective C-shaped surfaces 356 of the bearing units 344. The distance between collar members 372 and 374 is greater than the thickness of the bearing unit 344. The same is true for collar members 378 and 380. The distance between the tab 352 and an upper portion of L-shaped leg 348 is less than the diameter of journal portions 376 and 382. Hence, the roller 342 can easily be received by the bearing units 344**.

Figure 25:
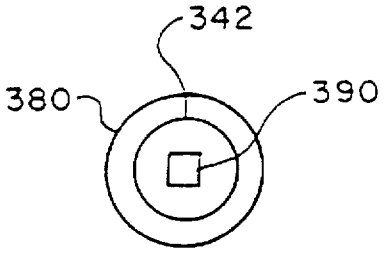
FIG. 25 is a view along line XXV—XXV of the roller shown in FIG. 22.
Figure 26:
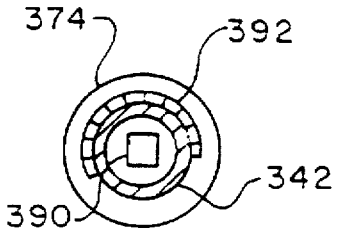
FIG. 26 is a section taken along line XXVI—XXVI of the roller shown in FIG. 22.
Figure 27:
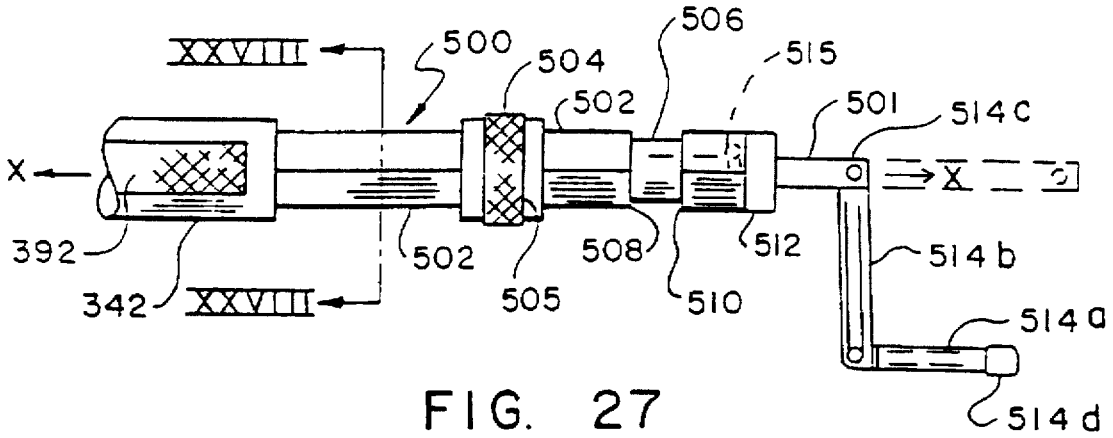
FIG. 27 is a partial view of another embodiment of the present invention showing a portion of a conveyor having a telescopic roller.
Figure 28:
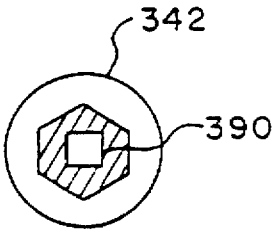
FIG. 28 is a section taken along lines XXVIII—XXVIII of FIG. 27.

A handle 384 is attached to an end of the roller 342. Handle 384 includes a hand-grabbing portion 385 and integral sections 386 and 388. Section 388 has a square cross-sectional profile and is adapted to be slidably received by square shaped slots 390 (as shown in FIG. 25 of the drawings) defined on opposite ends of the roller 342. A Velcro® strip 392 extends along the length of the roller 342 between collar members 374 and 378.

Figure 24B:
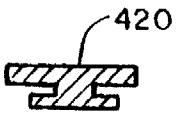
FIG. 24*b* is a section taken along line XXIVb—XXIVb of FIG. 24*a*.
Figure 24A:
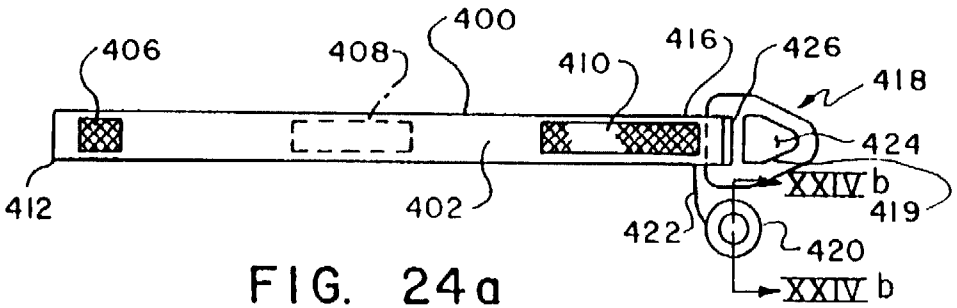
FIG. 24*a* is a top view of a strap and clip arrangement of the conveyor shown in FIG. 21.

FIGS. 21, 22 and 24*a* of the drawings show straps or belts 400 removably secured to the roller 342. Preferably, four straps 400 are provided, although more or less straps 400 may be necessary to move a patient. Each strap 400 includes a first side 402 and a second side 404. Velcro® fasteners 406 and 410, i.e., hook and loop fasteners, which are well known in the art, are attached at. opposite ends of side 402 of strap 400. A Velcro® fastener 408 is attached to a middle portion of side 404 of strap 400. A clip 418 is attached to an end 416 of strap 400. Clip 418 includes a body member 419 and a plug member 420, similar to that disclosed in U.S. patent application Ser. No. 08/330,808 and described previously herein. Straps 400 are spaced along the length of the roller 342. The straps 400 are made of flexible material, such as woven polyethylene, woven polypropylene or cotton. Preferably, the straps 400 should be at least as long as the bed sheet width. Fastener 408 (a loop fastener) is of sufficient length so that when the strap 400 is completely wound around the roller 342, it is releasably attached to fastener 410 (a hook fastener) and prevents the straps 400 from unwinding when the roller 342 is not in use.

The plug member 420 is attached to the strap 400 by a flexible string 422 to prevent the plug member 420 from being misplaced. The clip 418 includes a plug receiving slot 424 and a belt receiving slot 426. Preferably, the body 419 is made of high density polyethylene, ultra high molecular weight polyethylene, polypropylene, or other polyolefin, which is suitably flexible but sufficiently strong so as not to fail in use.

Plug member 420 includes three circular shaped rubber discs (See FIGS. 24*a* and 24*b* of the drawings) arranged so that the plug member 420 can pass through a portion of the plug receiving slot 424 and engage the sides of the plug receiving slot 424 at another section thereof so as to sandwich the sheet between the plug member 420 and the clip body 419.

To attach a sheet 430 to the roller 342, first straps 400 are spaced across the roller 342, as shown in FIG. 21 of the drawings to match the patient's weight distribution, i.e., moving a heavy person may require two straps 400 to be positioned next to each other and aligned with the patient's buttocks or stomach. In other situations, the straps 400 may be positioned differently, such as equally spaced apart across the sheet to move the patient. Then, the Velcro® fastener 406 of each strap 400 is releasably secured to the Velcro® strip 392. Fasteners 406 are either the loop or hook of Velcro® fastener and the Velcro® strip 392 is the other of the loop or hook Velcro® fastener. Preferably, the straps 400 are of a sufficient length to permit the roller 342 to be rotated until all of the straps are wound around the roller 342 at least one in a half times. I have found that this prevents disengagement of fasteners 406 from the Velcro® strip 392 of the roller 342, when the straps 400 become taut. Then, the clips 418 are attached to the sheet 430 near an edge 432 as shown in FIG. 21 of the drawings. Each strap 400 is extended so that an upper side of the sheet 430 rests on a lower surface of the clip body 419. The plug member 420 is then placed on a lower surface of the sheet 430 directly. under the plug receiving slot 424. Each respective plug member 420 is then pressed against the sheet 430 and moved toward the respective narrow portion of the plug receiving slot 424. The plug member 420 is moved within slot 424 until the sheet 430 is bound and sandwiched between the plug member 420 and the edges defining the plug receiving slot 424 so that the plug member 420 coacts with portions of the edges defined in plug receiving slot 424 to releasably attach the sheet 430 to the roller 342 of the conveyor 340.

To move a patient from a gurney to the bed 310, where the patient is resting on an upper surface 434 of the sheet 430 on the gurney (not shown), the roller 342 is rotated by the handle 384 about a longitudinal axis by rotating handle 384 about the longitudinal axis. Straps. 400 are wound on the roller 342, preferably so that the straps are initially wound about an upper tangent 450 of the roller 342. This causes sheet 430 to be pulled toward the roller 342 by clips 418 and straps 400. Rotation in a first direction of the roller 342 forces each plug member 420 to engage in the plug receiving slot 424, thereby further securing the sheet 430 to respective clip 418. Further, rotation of the roller 342 causes the journal portions 376 and 382 of the roller 342 to be pulled toward and against the C-shaped surface 356 which acts as the bearing surface. The upper portions of the C-shaped surface 356 defined by the tab 352 prevents the journal portions 376 and 384 from slipping out of the bearing units during the winding. Continued rotation of the roller 342 causes a patient lying on the surface 434 of the sheet 430 to be moved toward the bed 310 from the gurney and causes straps 400 and clips 418 to be wound on to the roller 342. Preferably, clips 418 are flexible enough to be wound around the roller 342. Continued rotation of the roller 342 causes the sheet 430 to wrap around the roller 342. Hence, the patient is moved by the sheet 430 from the gurney to the bed 310. The sheet 430 slides on an upper surface 434 of the mattress 322 during rotation. After the patient is positioned on the bed 310, the sheet 430 is removed from the roller 342 by unwinding the roller 342 to expose clips 418. Each plug member 420 is removed from the plug receiving slot 424 so that each clip 418 disengages from sheet 430. The roller 342 can then be removed from the bed 310 by lifting the journal portions 376 and 382 out of the respective bearing locking recesses 354. The above method can be reversed to move the patient from the bed to the gurney.

In some situations, the length of the beds found in hospitals can be varied. This is due to various bed frame lengths, as well as to the electric beds that change the position of the patient by moving the mattress. In that case, the roller 342 can be modified as shown in FIGS. 27–32 of the drawings. A telescopic arrangement 500 can be provided with roller 342. Telescopic arrangement 500 replaces end 343*a*, collar members 372 and 374, journal portion 376 and handle 384 of conveyor 340. A handle 501 is secured to an end on the telescopic arrangement 500. A hexagonally shaped hole is defined in the roller 342 at one end thereof and a hexagonally shaped telescoping member 502 is slidably received by the end of the roller 342 (See FIGS. 27 and 28 of the drawings). A sleeve 504 having a hexagonally shaped bore passing therethrough is slidably received by the hexagonally shaped telescopic member 502. A Velcro® strip 505 of a similar type as strip 392 is attached to the sleeve 504. A recessed journal portion 506 is defined at an end of the hexagonally shaped telescoping member 502. Guide surfaces 508 and 510 are defined by the telescoping member 502 adjacent the recessed journal portion 506. An end cap 512 is attached to an end of the telescoping member 502 and includes a square hole 513 as shown in FIG. 32.

Figure 29:
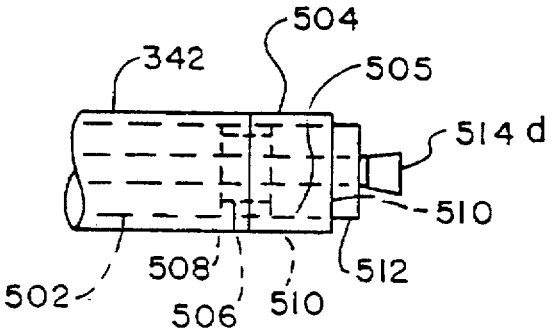
FIG. 29 is a partial plan view of the telescopic roller shown in FIG. 27 in a closed position.
Figure 30:
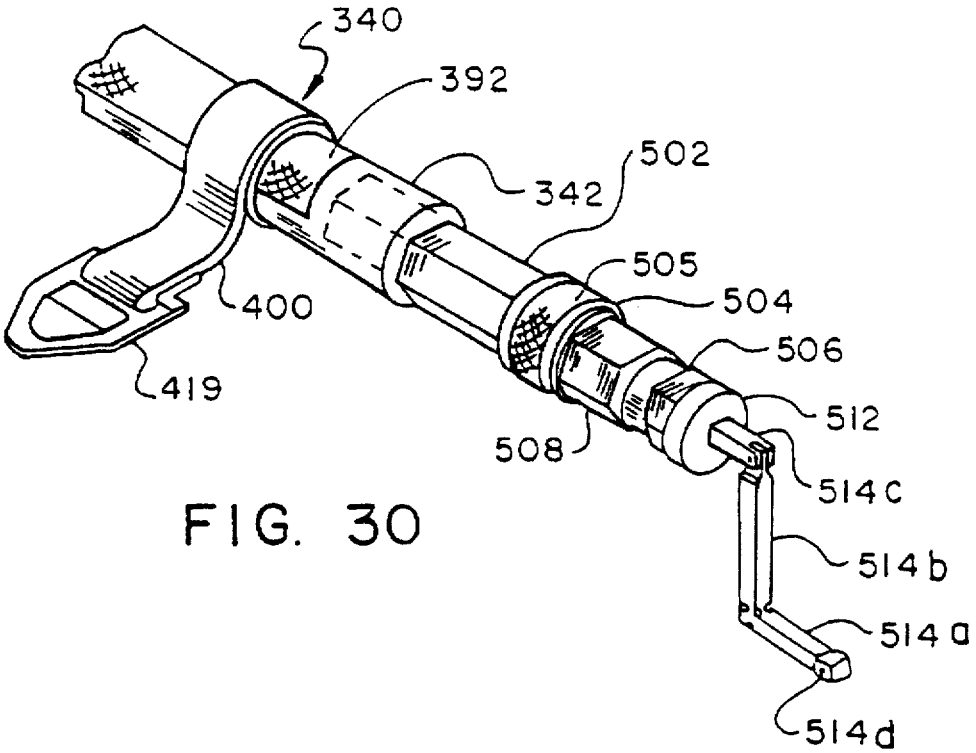
FIG. 30 is a perspective view of a portion of the conveyor roller shown in FIG. 27 in an extended position.

The handle 501 includes segments 514*a*, 514*b* and 514*c*. Handle segments 514*a*, 514*b* and 514*c* are pivotally secured to each other and can be arranged in a straight position (as shown in phantom in FIG. 27 of the drawings) and slid through hole 513 as shown in FIG. 29 of the drawings. Segments 514*a*, 514*b* and 514*c* have a square cross-section. If the handle 501 is extended in a longitudinal direction to the straight portion, it can be slidably received by the telescoping member 502 through the hole 513 and a hole defined in telescoping member 502.

The outer perimeter of section 514*c* is slightly smaller than slot 513. Hence, rotating handle section 514*c* about the longitudinal axis X will rotate roller 342 about the longitudinal axis X. A stop 514*d* is attached to handle 501 and abuts end cap 512 when the handle 501 is passed through hole 513 as shown in FIGS. 29 and 31.

In operation, straps 400 can be placed on both the Velcro® strip 392 as well as the Velcro® strip 505 on sleeve 504. Recessed journal portion 506 is removably received by bearing unit 344. Operation of the modified roller is similar to that as previously discussed except that as the length of the bed 310 changes so does the length of the conveyor 340. Specifically, the hexagonally shaped telescoping member 502 will either slide in or slide out of the slot defined in the roller 342, thereby changing the overall length of the conveyor 340. Preferably, a strap 400 is attached to the Velcro® strip 505 of the sleeve 504 in a similar manner as previously discussed in attaching the strap 400 to the Velcro® strip 392. Rotation of the handle 501 about the longitudinal axis X will cause the telescoping member 502 to rotate about the longitudinal axis which, in turn, causes both the sleeve 504 and roller 342 to rotate about the longitudinal axis. This is due to the handle 501 coacting with the end cap 512, and the telescoping member 502 coacting with the sleeve 504, the roller 342 and end cap 512 about the longitudinal axis X.

Figure 31:
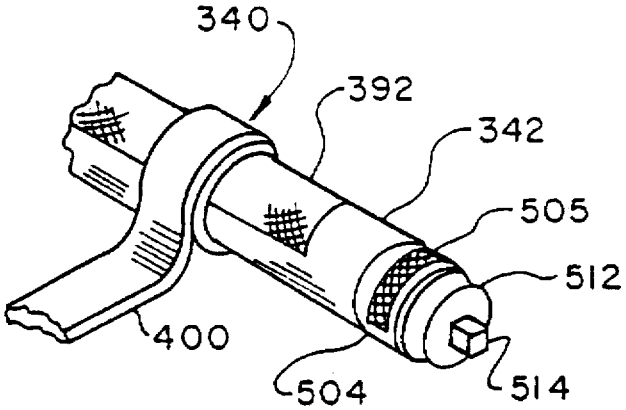
FIG. 31 is a perspective view of the conveyor roller shown in FIG. 30 in a retracted position.
Figure 32:
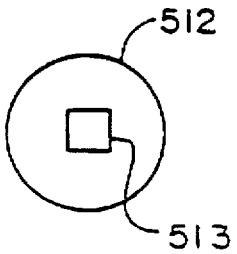
FIG. 32 is a front view of a top cap shown in FIG. 27.

After the patient is moved onto the bed 310 from the gurney, the roller 342 can be removed from the bearing units 344 as previously discussed and the handle 501 can be slid within telescoping member 502 which then can be slid within roller 342 to result in a compact design as shown in FIGS. 29 and 31 of the drawings. Alternatively, roller 342 can be permanently attached to a bed at journal portions 506 and 382 to bearings. Further, a non-folding handle 384 can replace handle 501 or vice versa. Furthermore, telescopic arrangements can be provided at both ends of the roller 342 as opposed to only one end.

Figure 33:
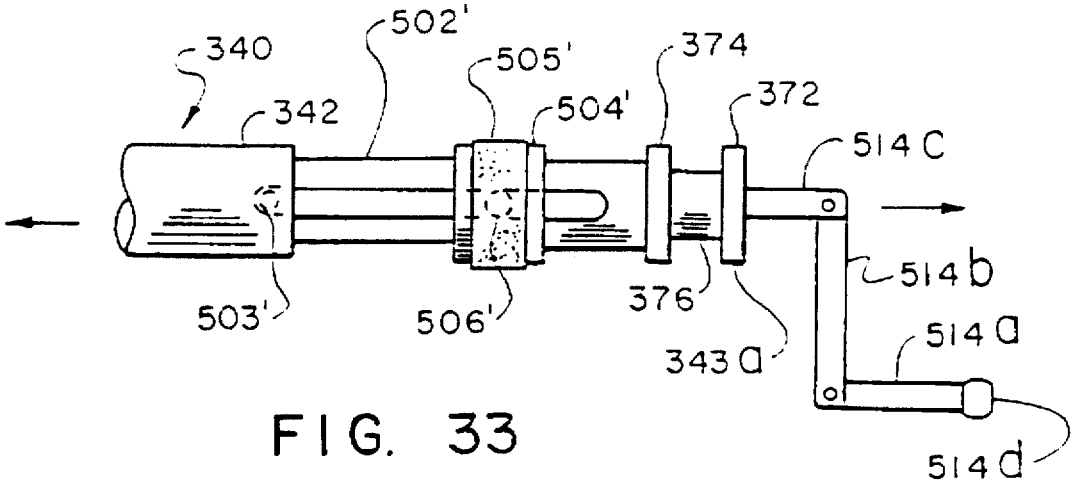
FIG. 33 is a partial view of another embodiment of the present invention showing a portion of a conveyor having a telescopic roller.

Another embodiment of the roller 342 is shown in FIG. 33 of the drawings. Telescoping member 502' is slidably received by roller 342 through a circular hole. An elongated slot is defined in member 502'. A pin 503' is secured to an end of roller 342 and passes through the slot and slidably guides member 502' along the X axis. A cylindrical sleeve 504' having a circular hole is slidably received on member 502'. A Velcro® strip 505', similar to the Velcro® strip 505, is attached to sleeve 504'. A pin 506' is secured to sleeve 504' and slidably passes through the slot. Collar members 372 and 374 and journal portion 376 (as previously described) are provided at an end of member 502'. A segmented handle 501 having segments 514*a*–514*c*, as previously described, is secured to collar member 372 and is adapted to pass through a square shaped slot defined in collar member 372 in a manner similar to the handle used in the embodiment shown in FIG. 27. The journal member 376 is adapted to be slidably received by bearing unit 344 as previously described. The features of the roller 342, shown in FIG. 33, can be combined with any of the other rollers 342 shown. The length of the roller 342 can be changed by extending the member 502' from the hole defined in the roller 342 or retracting the member 502' within the hole. In the embodiments shown in FIGS. 27–32, the rollers extend in a longitudinal direction and the slidably received sleeves are adapted to move in the longitudinal direction on the respective telescoping member.

Figure 34:
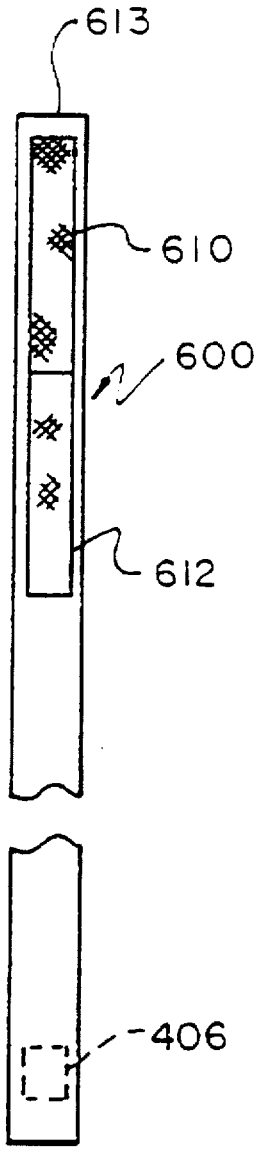
FIG. 34 is a top view of another embodiment of the strap made in accordance with the present invention.
Figure 35:
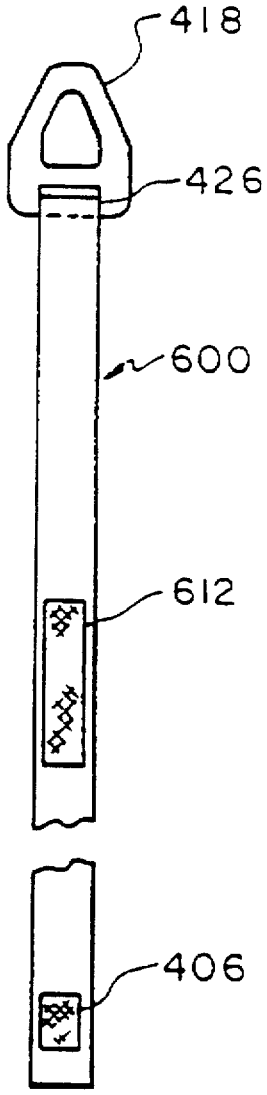
FIG. 35 is a top view of a clip and the strap of the embodiment shown in FIG. 34.

FIGS. 34 and 35 of the drawings, show another embodiment of a strap 600, which is similar to strap 400 except for the below-noted differences. I have found that sometimes the bed sheet stretches differentially due to the patient's unique weight distribution, and although the patient can be transferred, this differential stretching causes the patient's body to bend out of alignment. To overcome this problem, an alternative strap 600 can be provided having a Velcro® hook fastener portion 610 and a Velcro® loop fastener portion 612 positioned adjacent thereto. The clip 419 is removably received by a clip receiving end 613 of the strap 600. Specifically, the clip receiving end 613 of the strap 600 is looped through slot 426 of the clip 418 so that Velcro® portion 610 can contact Velcro® portion 612 and be releasably secured thereto. The straps 600 are then fastened to the roller in the same manner as straps 400 and clips 418 are releasably secured to the sheet 430 in the same manner previously described. The roller 342 is then wound as described above until at least one of the straps 600 becomes taut. At that time, the person rotating the roller places his or her thigh against the roller 342 so as to press the journal portions 376 and 382 of roller 342 against bearing surfaces 356, thereby preventing the roller from rotating about the longitudinal axis X. Then, all of the straps 600 can be made taut by releasing Velcro® sections 610 and 612 from each other, and pulling on each section 610 until each of the respective straps 600 is taut and then releasably resecuring section 610 to section 612. After this procedure is completed for each strap 600, the roller 342 is wound as previously described. It is believed that Velcro® sections 610 and 612 can be replaced by a buckle to adjust the length of the straps 600, as long as the buckle does not impede the straps' ability to be wound around the roller.

Figure 36:
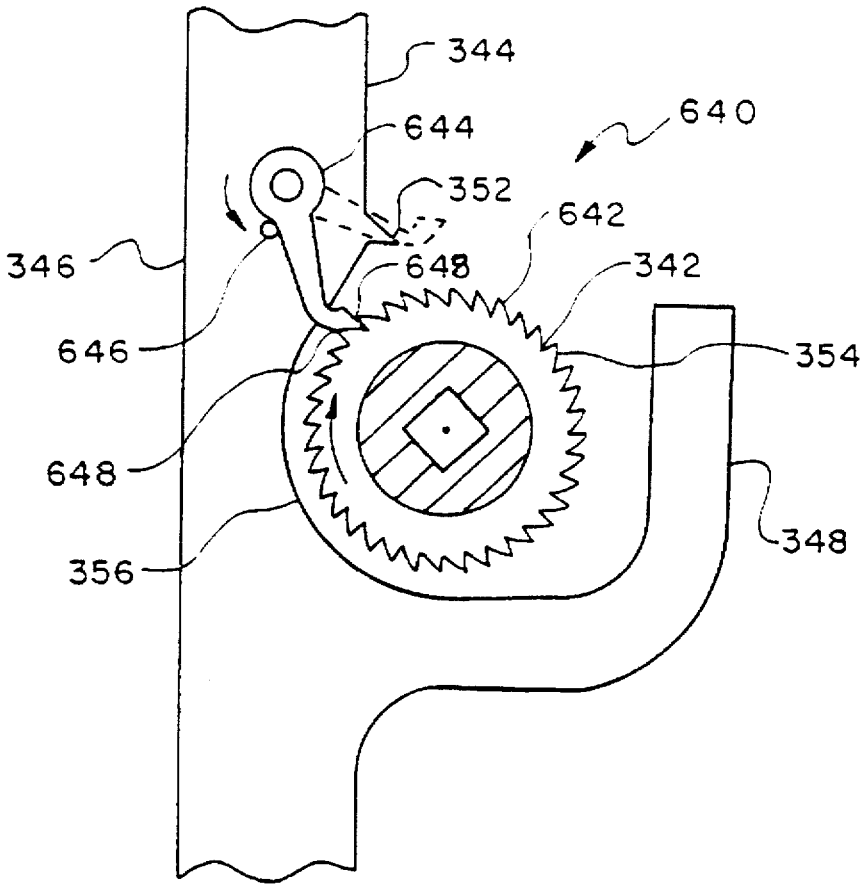
FIG. 36 is a partial side view of a locking mechanism used with the conveyor of the present invention.

Alternatively, a pawl and ratchet arrangement 640, as shown in FIG. 36 of the drawings, can be provided in lieu of using the thigh to stop the rollers. The pawl and ratchet arrangement 640, as shown, is used with the embodiment shown in FIGS. 21–27 of the drawings, but can be used with any of the described rollers. The pawl and ratchet arrangement 640 includes a toothed ratchet wheel 642 secured to an end of the roller 342 adjacent the collar member 372. A spring loaded pawl 644 is secured to a side wall of one of the bearing units 344. A torsional spring (not shown) is secured to the pawl 644 and the side wall of the bearing unit causes the pawl 644 to abut against a stop 646, such as a post, secured to and extending from the bearing side wall.

The roller 342 is secured to the bearing as previously described. As the roller is rotated about the longitudinal axis X in a first tightening direction (such as the clockwise direction), at least one of the straps 600 will become taut. The roller will be drawn toward the C-shaped surface 356 and pawl 644 will engage with the ratchet wheel 642, so that the pawl 644 is received between respective teeth 648 of the ratchet wheel 642. Any attempt to rotate the roller in a second direction (i.e., the counterclockwise direction) to unwind the roller will be prevented by the pawl and ratchet arrangement 640.

The remainder of the straps 600 can be adjusted as previously described, and the patient can then be moved by the roller 342. The roller can easily be removed by rotating the pawl in a non-engaging position as shown in phantom in FIG. 34 or by loosening all of the straps 600 from the sheet, moving the roller away from the C-shaped surface 356 and then removing the roller 342 from the bearing units 344 through the open ended slots.

Figure 37:
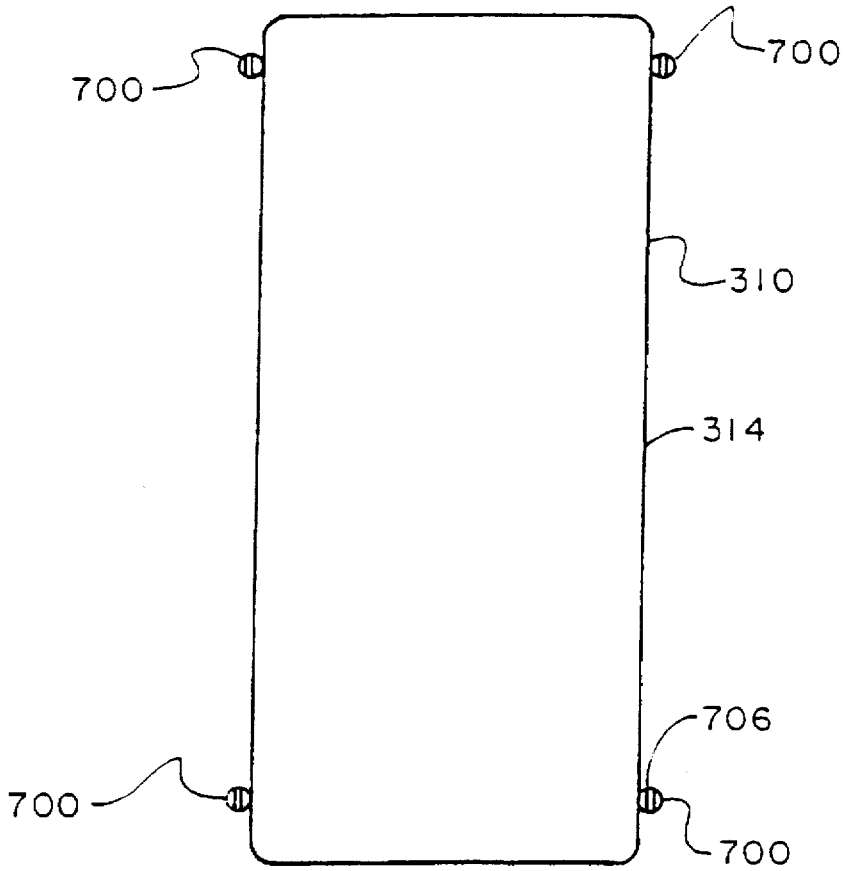
FIG. 37 is a top view of a bed having bearing holder tubes positioned adjacent the corners of the bed.

In some hospital beds, it is not feasible to fasten the bearing units 344 to the headboard or baseboard. In that case, the bearing units 344 can be removably secured to the bed frame through tubes 700 shown in FIGS. 37–39. In many cases, the tubes 700 are already provided adjacent the four corners of the bed frame and are used as intravenous (IV) tube holders which can be used to support. posts that hold bags supplying intravenous (IV) drugs to a patient.

Figure 38:
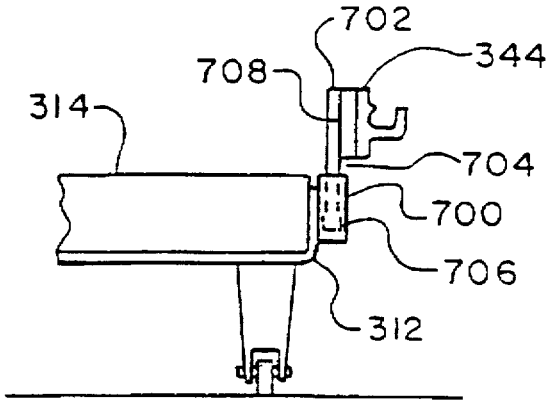
FIG. 38 is a side view showing the bed shown in FIG. 37 with a bearing holder and a post made in accordance with the present invention.
Figure 39:
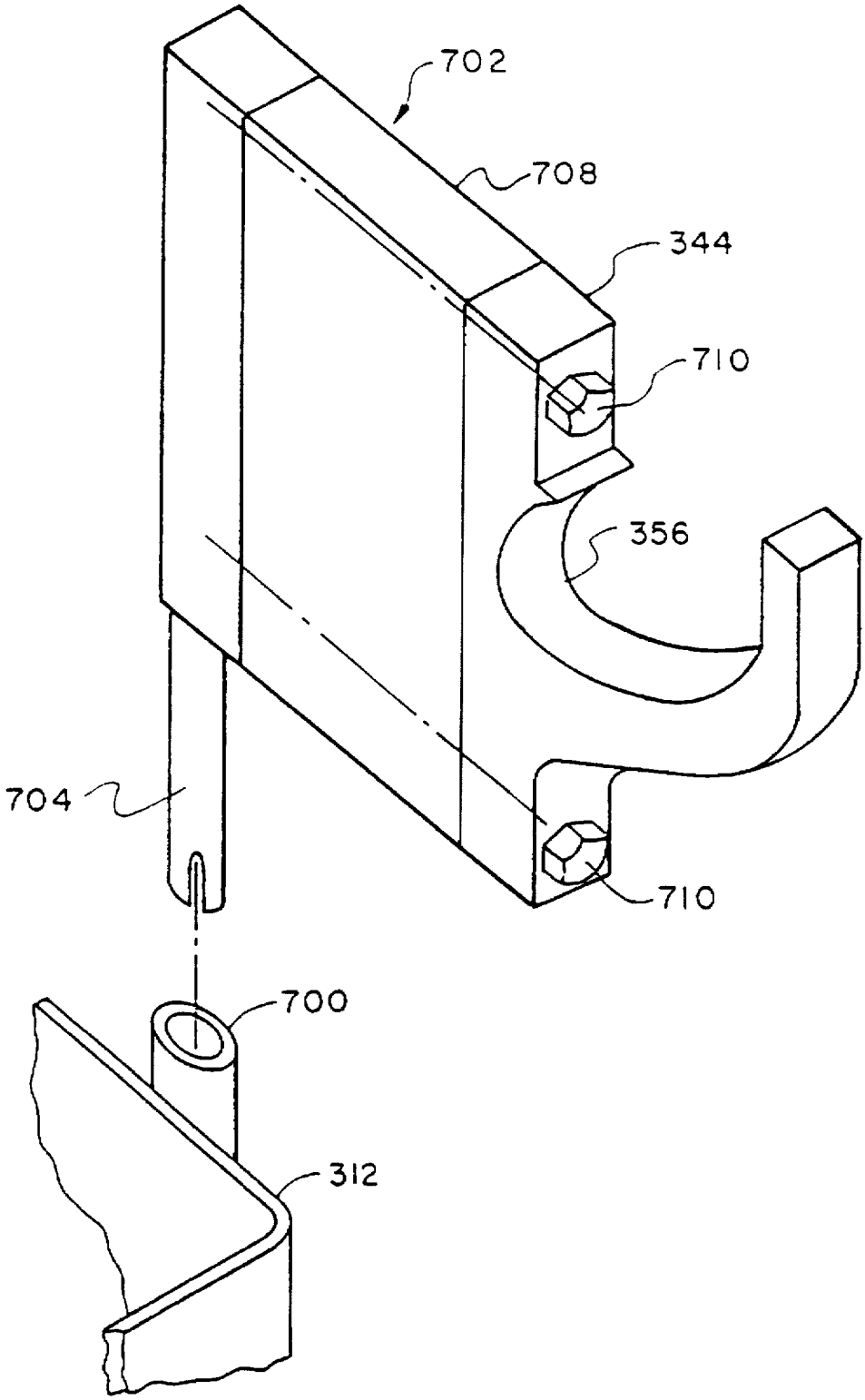
FIG. 39 is a top perspective fragmentary view showing the bearing holder and the post shown in FIG. 38.

As shown in FIGS. 38 and 39 of the drawings, a bearing holder 702 is provided and includes an elongated post 704 adapted to be received by the tube 700. The post 704 includes a rectangular upper portion and a lower cylindrical portion having a slot defined at a lower end thereof adapted to engage a pin 706 positioned in each of the tubes 700. A plastic spacer block 708 is secured to the upper portion of the post 704. The bearing unit 344 (as previously described) is then secured to the post 704 and spacer block 708 by bolts 710. Preferably, the post is made of high strength steel, such as "4140" tool steel.

In operation, two bearing holders 702 are positioned on opposite ends of one side of the bed 310 in. tubes 700 so that the bearing assemblies 344 face away from the bed and the post slots engage respective pins 706. The roller ends **343*a* and 343*b* are secured to the respective bearing assemblies 344 and the straps 400 are secured to the sheet as previously described. Similar tubes 700 can be provided on a gurney and hence, the roller 342 and bearing holders 702 can be removably attached to the gurney, in lieu of the bed, in the same manner described. After the patient is moved, the roller 342 and the bearing holders 702** are preferably removed from the bed.

In an alternative arrangement, the roller can be permanently secured to the bearing assemblies 344 and bearing holders 702 so that the whole assembly can be removably received by the tubes 700.

Figure 40:
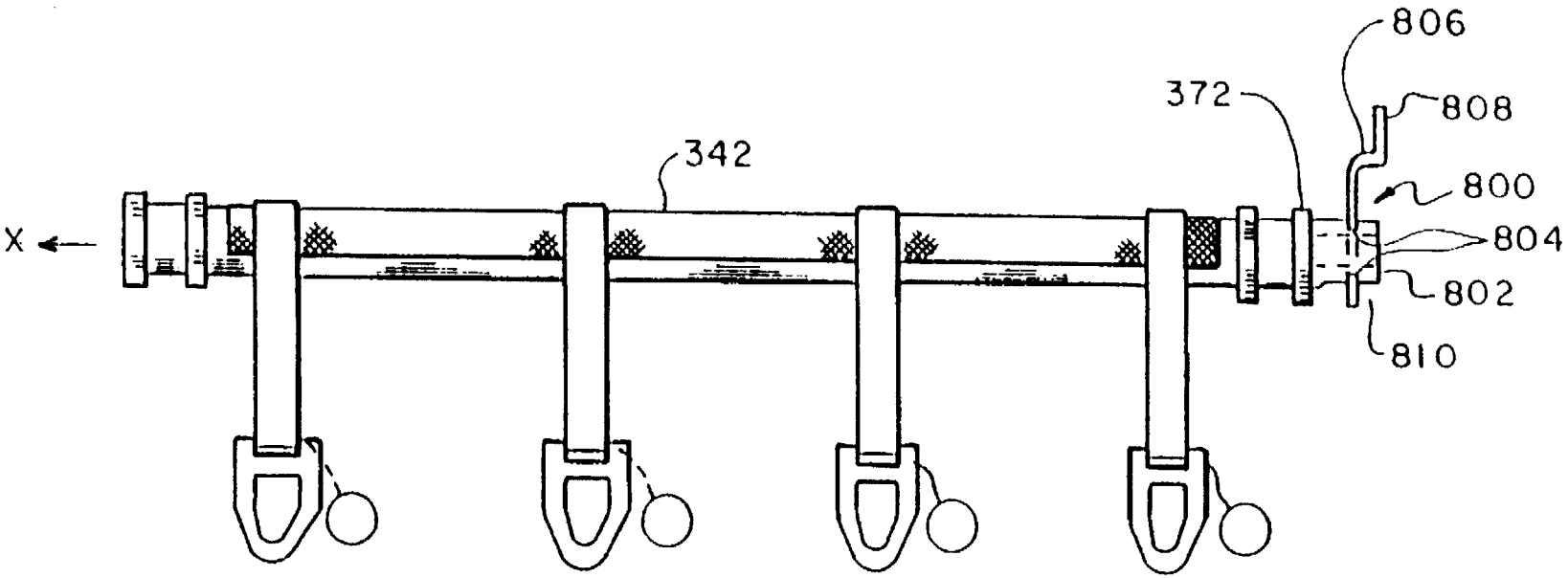
FIG. 40 is a plan view of a roller assembly similar to that as shown in FIG. 22 with a different handle.

FIG. 40 shows another embodiment of a roller similar to roller 342 with the exception of the handle 384. A driving arrangement 800 is secured to collar member 372, which is similar to the driving arrangement disclosed in U.S. Pat. No. 5,340,266. Driving arrangement 800 includes a substantially cylindrical coupling 802 having an end fixedly secured to collar member 372. Aligned elongated rectangular slots 804 pass through the side of the coupling 802. A crank handle 806 having a rectangular cross-section is adapted to be slidably received by the slots 804. An extension 808 of the handle permits a user to rotate the handle 806 about the X axis, similar to handle 384. Preferably, the handle 806 is removed from the slots 804 after the patient is moved. Also, the base portion 810 of the handle is adapted to fall out of the slots 804 when the extension 808 is positioned adjacent the floor and no one is holding onto the extension 808. This prevents a bystander from getting hit by the handle 806 when the roller is rotated in a fashion other than rotating the roller by the handle, i.e., pulling a rolled up sheet from the roller to expose the clips to remove the sheet from the straps. Handle 806 can be incorporated with any of the rollers described herein.

Figure 41:
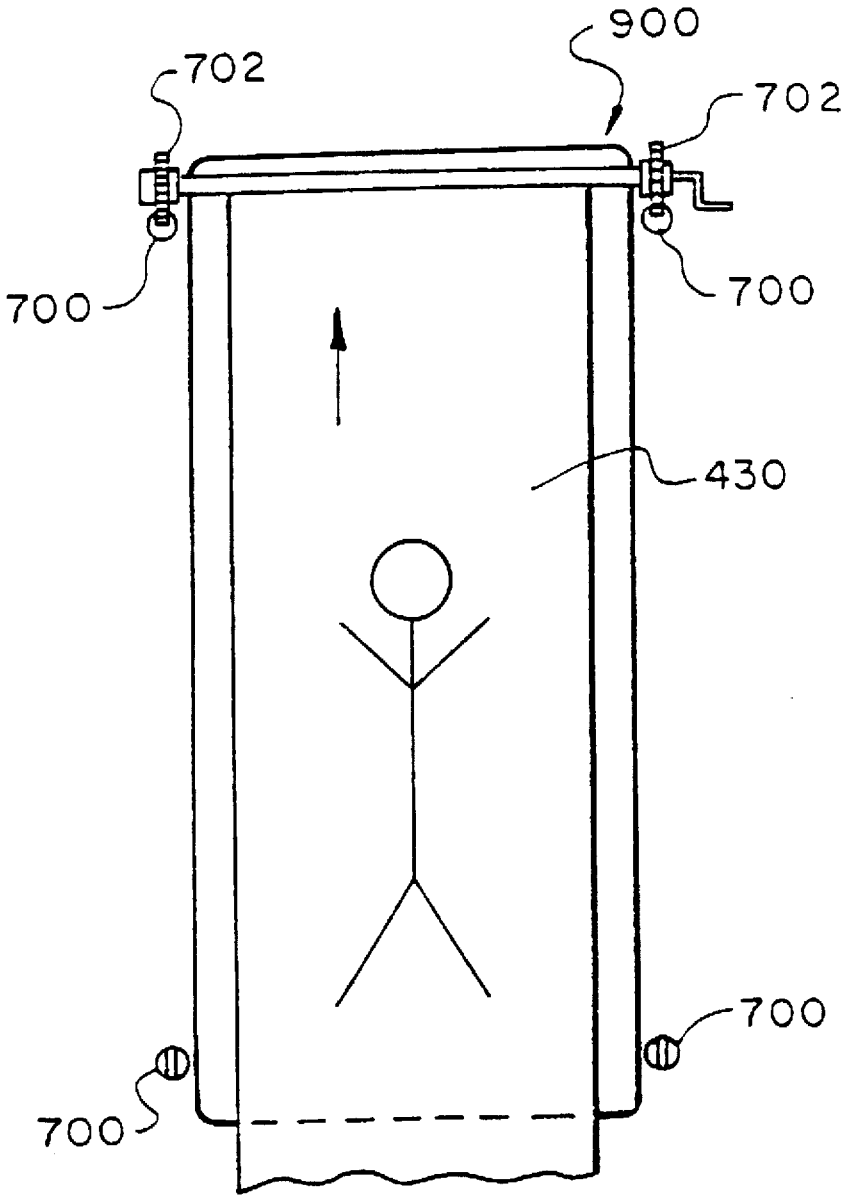
FIG. 41 is a top view of a bed having a conveyor made in accordance with the present invention positioned at the head of the bed.

FIG. 41 shows another embodiment of the present invention where a conveyor 900, similar to any of the conveyors previously shown, is removably secured and positioned adjacent to the head of a bed.

In this manner, the patient can be moved from the foot of the bed toward the head of the bed by wrapping the sheet 430 around the roller of the conveyor 900. Preferably, tubes 700 and bearing holders 702 are provided so that the conveyor can be removed after the patient is moved. Also, in this arrangement, the conveyor 900 can be secured to the foot of the bed to pull the patient toward the foot of the bed. Preferably, the conveyor 900 includes a telescoping member so that its length can be sufficiently changed and adapted to be positioned at the head or foot of the bed, or adjacent one of the sides of the bed.

Figure 42:
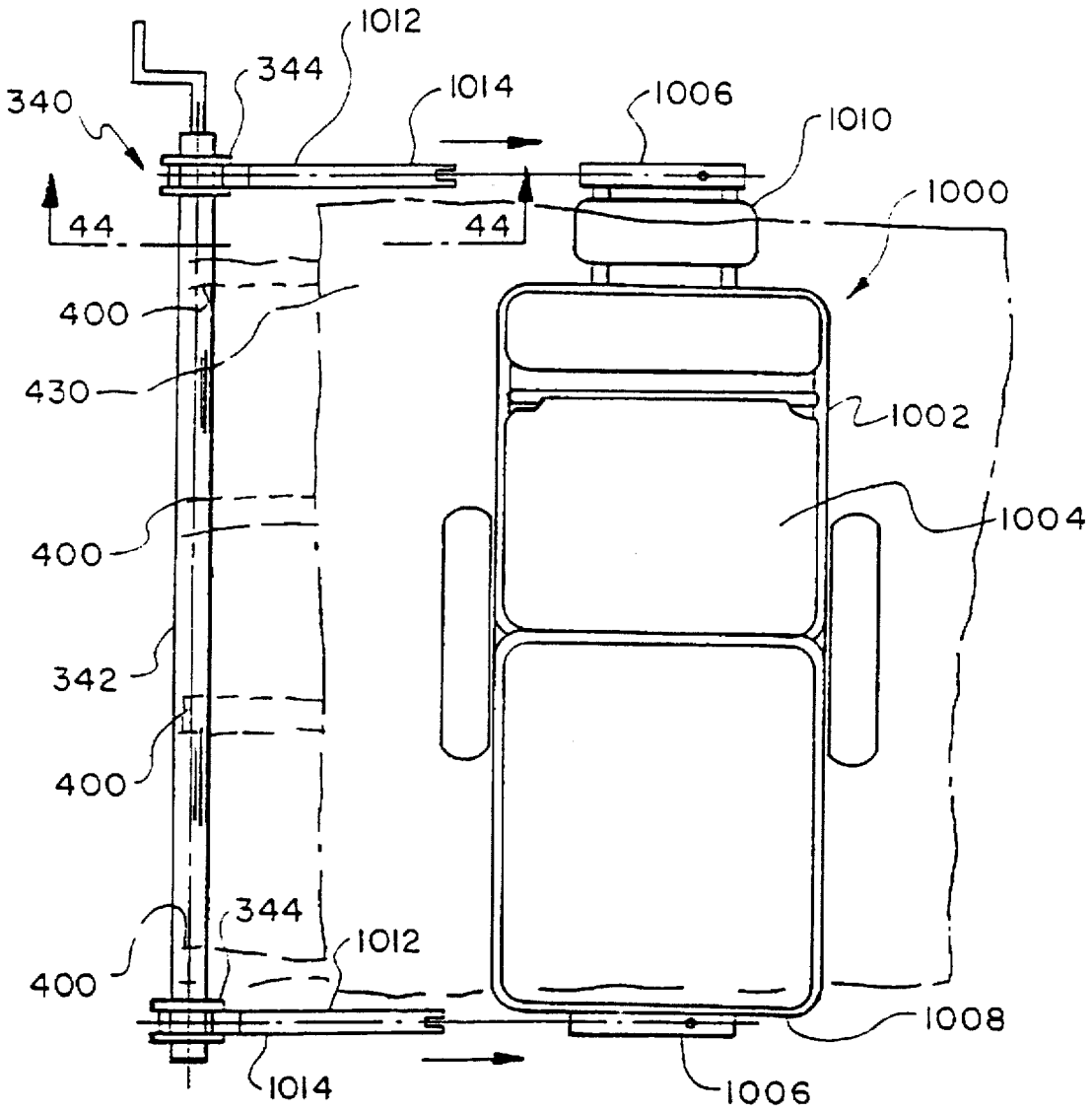
FIG. 42 is an exploded top plan view of another embodiment of the present invention showing a conveyor for use with a gurney that converts into a wheelchair.
Figure 43:
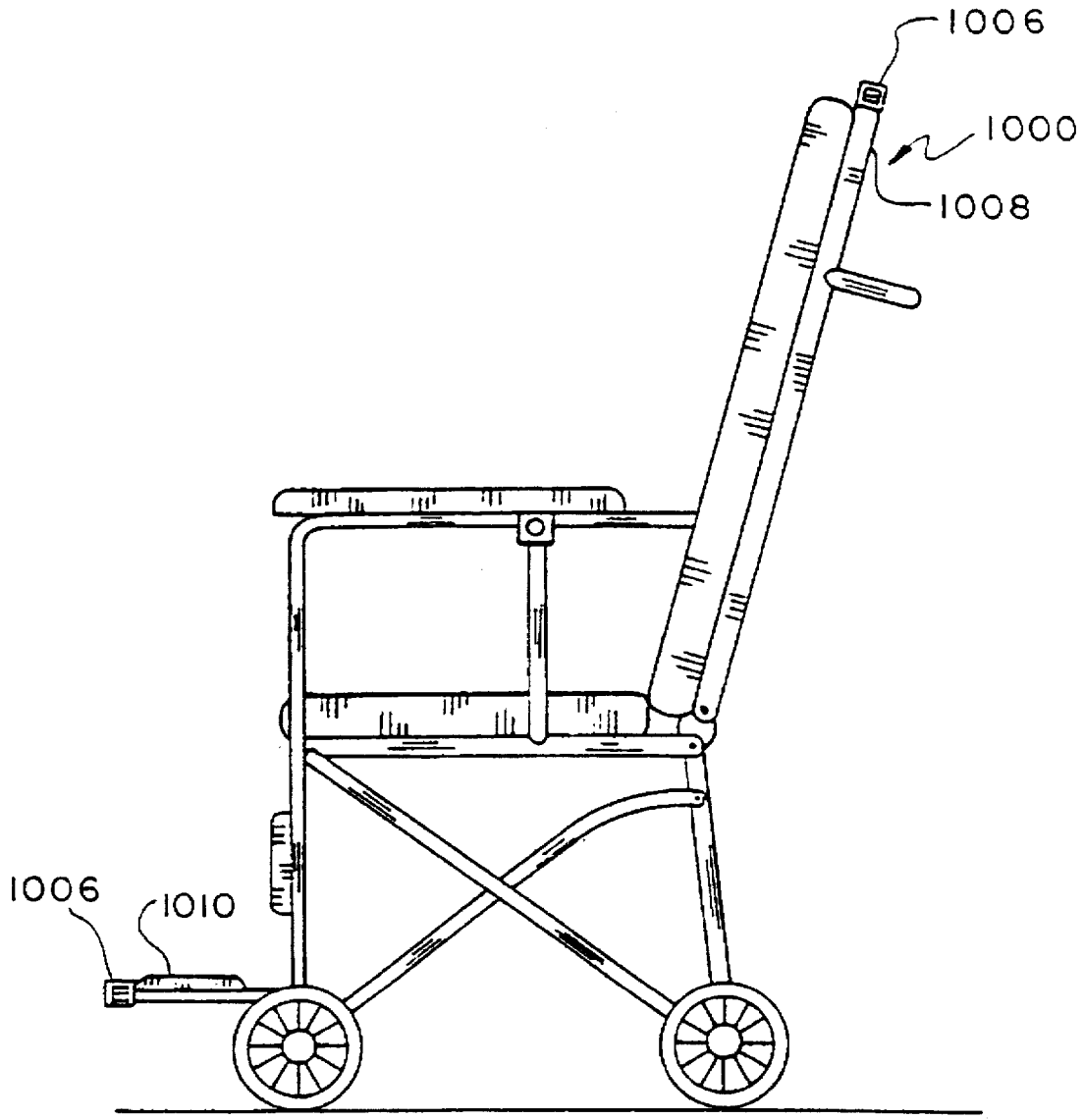
FIG. 43 is a side view of the gurney shown in FIG. 42 converted into a wheelchair.
Figure 44:
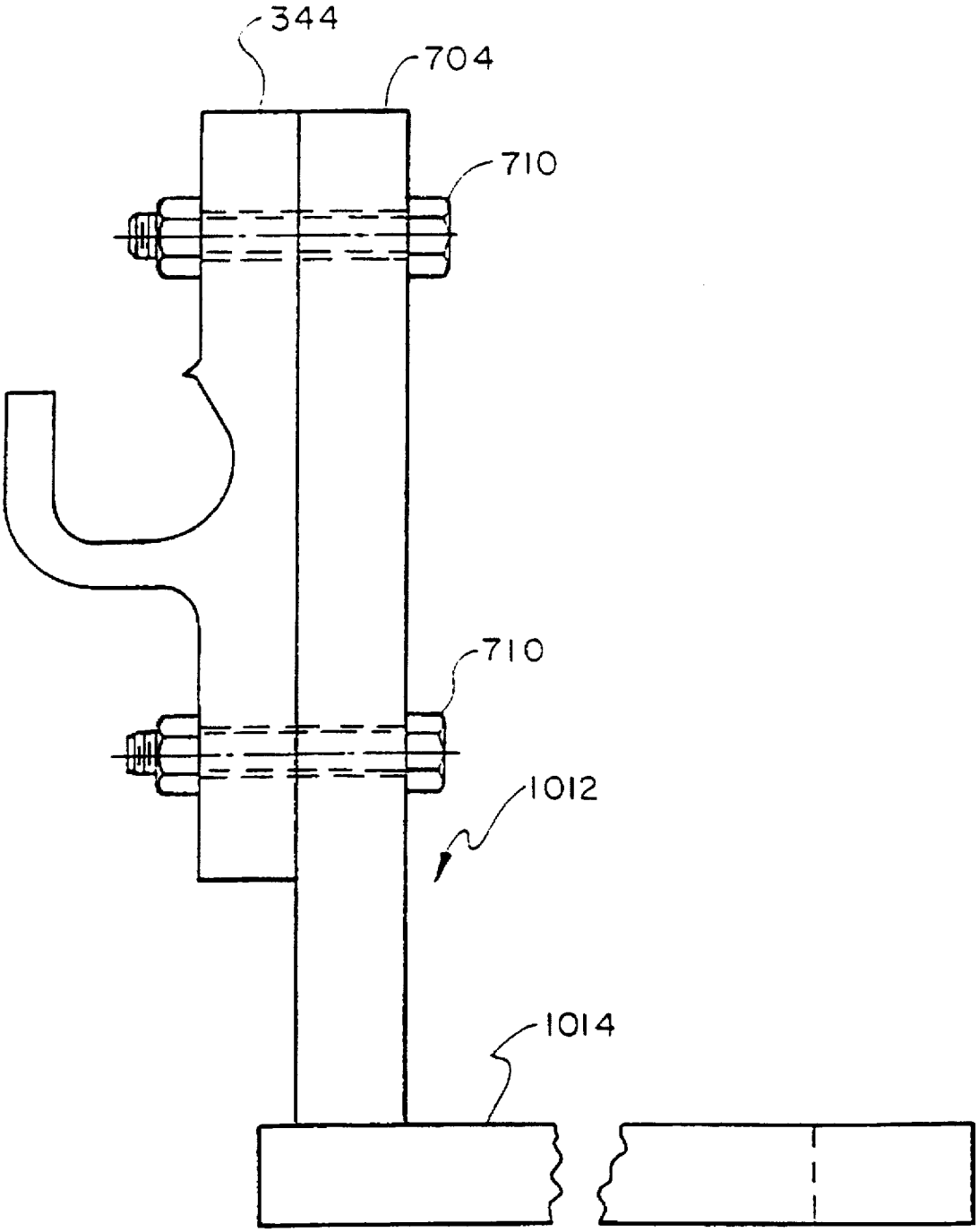
FIG. 44 is a side view of a bearing unit shown in FIG. 42.

FIGS. 42–44 show another embodiment of my invention and relate to gurneys that convert into wheelchairs. Presently, Guardian Products, Inc., located at 12800 Wentworth Street, Arieta, Calif. 91331, sells a wheelchair that converts into a gurney under the trademark Medi-Chair™. Such convertible gurneys are well-known in the art. FIGS. 42 and 43 show a convertible gurney 1000, such as the Medi-Chair™ convertible gurney Model Nos. 020-0205 and 020-0206A, where the convertible gurney 1000 is in the gurney state (FIG. 42) and the convertible gurney is in the wheelchair state (FIG. 43). The convertible gurney 1000 includes a frame 1002 and a patient supporting member 1004 attached to the frame 1002. Hollow tube holders 1006 are secured, preferably by bolting or welding, to the frame 1002 adjacent a head section 1008 and foot section 1010 of the convertible gurney 1000.

As shown in FIGS. 42 and 44 of the drawings, two bearing holders 1012 are provided, wherein each includes a horizontal post 1014. Posts 1014 are adapted to be removably received by respective tube holders 1006. Bearing holder 1012 is similar to bearing holder 702 in that the bearing unit 344 is attached to a vertical post 708 by fasteners 710. In the case of bearing holder 1012, vertical post 704 is attached to horizontal post 1014 as shown in FIG. 44 of the drawings.

Moving a patient from a bed to the convertible gurney 1000 is explained as follows. First, the convertible gurney 1000 is converted into the gurney state as shown in FIG. 42 and moved toward a bed when a patient is lying on a sheet. Bearing holders 1012 are then slideably and removably received into the tube holders 1006 at the head section 1008 and the foot section 1010, so that the bearing units 344 are positioned adjacent the side of the gurney furthest from the bed. The roller 342 is then received by the bearing units 344 and the sheet 430 shown in phantom is removably secured thereto by straps 400 shown in phantom as previously described.

The handle of the conveyor 340 is then rotated and the patient is moved onto the convertible gurney 1000 so that the patient's head is preferably near the gurney's head section 1008 and the patient's feet are adjacent the foot section 1010. The sheet is then removed from the roller 342 and the conveyor 340 and bearing holders 1012 are removed from the convertible gurney 1000. End portions of the sheet can then be tucked under the patient and the convertible gurney 1000 can be converted into a wheelchair as shown in FIG. 43. To return the patient to the bed, the convertible gurney 1000 is converted from a wheelchair to a gurney; and the above method is then reversed to move the patient from the convertible gurney 1000 to a bed, with the exception of securing the conveyor 340 to the bed at the side furthest from the gurney 1000 in a manner similar to moving a patient from a gurney to a bed as previously described herein.

Having described the presently preferred embodiments of my invention, it is to be understood that it may be otherwise embodied within the scope of the following claims.

I claim:

1. An apparatus for transporting a patient comprising:

a) a base;

b) a patient supporting member attached to said base;

c) a conveyor removably secured to said base, wherein said conveyor includes a roller extending in a longitudinal direction having a sleeve slidably received on said roller and movable in the longitudinal direction;

d) a sheet having a first end and a second end, said first end attached to said conveyor, wherein said sheet is adapted to be positioned onto said pateint supporting member; and e) a flexible strap having two ends, one end of said strap attached to said sleeve and the other end of the strap releasably attached to said sheet.

2. An apparatus for transporting a patient as claimed in claim 1, wherein said roller is rotatably secured to said base, said roller comprising one of a group of graphite fibers, aluminum, fiberglass and steel.

3. An apparatus for transporting a patient as claimed in claim 1, wherein said roller includes a first end and a second end, wherein said sheet first end is attached to said roller, and a bearing removably secured to said roller.

4. An apparatus for transporting a patient as claimed in claim 3, wherein said bearing is removably and rotatably secured to said first end of said roller.

5. An apparatus for transporting a patient as claimed in claim 4, further comprising a second bearing removably and rotatably secured to said second end of said roller.

6. An apparatus for transporting a patient as claimed in claim 3, wherein said patient supporting member is secured to said base.

7. An apparatus for transporting a patient as claimed in claim 3, wherein said bearing comprises a first leg and a second leg attached to said first leg, said first leg of said bearing and said second leg of said bearing defining an open ended roller receiving recess that receives said one of said roller first end and said roller second end.

8. An apparatus for transporting a patient as claimed in claim 7, wherein said bearing further comprising a tip extending from one of said first leg and said second leg into said roller receiving recess.

9. An apparatus for transporting a patient as claimed in claim 8, wherein said tip extends from said first leg, said tip and said first leg defining a concave inner surface and said second leg having an inner surface, said concave surface and said second leg inner surface defining a roller engaging recess.

10. An apparatus for transporting a patient as claimed in claim 7, wherein said roller further comprises a pair of spaced collar members, said bearing received by said roller between said collar members.

11. An apparatus for transporting a patient as claimed in claim 3, wherein said roller further comprises a pair of spaced collar members, said bearing received by said roller between said collar members.

12. An apparatus for transporting a patient as claimed in claim 3, further comprising means for preventing unwinding of said sheet around said roller.

13. An apparatus for transporting a patient as claimed in claim 12, wherein said means for preventing unwinding of said sheet around said roller comprises a pawl attached to one of said roller and said bearing and a toothed ratchet attached to the other of said bearing and said roller, said pawl adapted to engage with said ratchet to permit rotation of said roller in a first direction and prevent rotation of said roller in a second direction.

14. An apparatus for transporting a patient as claimed in claim 13, further comprising means to disengage said pawl from said ratchet.

15. An apparatus for transporting a patient as claimed in claim 1, wherein said sheet is removably attached to said conveyor by a fastener attached to said conveyor.

16. An apparatus for transporting a patient as claimed in claim 1, further comprising a second flexible strap having two ends, one end of said second flexible strap releasably attached to said roller and said other end of said second flexible strap releasably attached to said sheet.

17. An apparatus for transporting a patient as claimed in claim 16, further comprising means for adjusting the position of said second flexible strap along a length of said roller.

18. An apparatus for transporting a patient as claimed in claim 17, wherein said means for adjusting the position of said second flexible strap along a length of said roller comprises one of a plurality of hook fasteners and a plurality of loop fasteners attached to said roller and the other of said plurality of hook fasteners and loop fasteners attached to said one end of said flexible strap.

19. An apparatus for transporting a patient as claimed in claim 1, further comprising a clip attached to said other end of said flexible strap for removably attaching to said sheet.

20. An apparatus for transporting a patient as claimed in claim 19, wherein said clip is releasably attached to said second flexible strap.

21. An apparatus for transporting a patient as claimed in claim 1, further comprising means for adjusting the length of said second flexible strap.

22. An apparatus for transporting a patient as claimed in claim 1, wherein said conveyor comprises a means for adjusting the length of said roller.

23. An apparatus for transporting a patient as claimed in claim 22, wherein said roller comprises a first longitudinally extending member and a second longitudinally extending member slidably received by said first longitudinally extending member.

24. An apparatus for transporting a patient as claimed in claim 23, wherein said first longitudinally extending member defines a longitudinally extending recess at an end thereof and said second longitudinally extending member is slidably received by said first longitudinally extending member in said recess.

25. An apparatus for transporting a patient as claimed in claim 24, wherein the end of said first longitudinally extending member defines a recess having the same geometric shape as a cross-sectional shape of said second longitudinally extending member.

26. An apparatus for transporting a patient as claimed in claim 24, wherein said sleeve is slidably received by said second longitudinally extending member.

27. An apparatus for transporting a patient as claimed in claim 24, wherein said roller extends along a first longitudinal axis and said second longitudinally extending member is slidably movable along the first longitudinal axis relative to said first longitudinally extending member and said second longitudinally extending member is drivingly engaged with said first longitudinal member so as to rotate said first longitudinally extending member about said first longitudinal axis when said second longitudinally extending member is rotated about the first longitudinal axis.

28. An apparatus for transporting a patient as claimed in claim 22, further comprising a handle secured to said roller.

29. An apparatus for transporting a patient as claimed in claim 28, wherein said handle is segmented and slidably received by said roller.

30. An apparatus for transporting a patient as claimed in claim 1, further comprising means for removably securing said conveyor to said base.

31. An apparatus for transporting a patient as claimed in claim 30, wherein said means for removably securing said conveyor to said base comprises a tube and a post slidably received by said tube, wherein one of said post and said tube is secured to said base and the other of said post and said tube is secured to said conveyor.

32. An apparatus for transporting a patient as claimed in claim 31, wherein said conveyor comprises a roller having a first end and a second end, wherein said sheet first end is attached to a roller, and a bearing member removably secured to said roller, said bearing member secured to said post and said tube.

33. An apparatus for transporting a patient as claimed in claim 32, wherein said post is fixedly secured to said bearing member.

34. An apparatus for transporting a patient as claimed in claim 1, wherein said base and said patient supporting member form a bed.

35. An apparatus for transporting a patient as claimed in claim 1, wherein said base and said patient supporting member form a gurney.

36. An apparatus for transporting a patient as claimed in claim 1, wherein said base and said patient supporting member form an apparatus that is adapted to convert from a gurney to a wheelchair.

37. An apparatus for transporting a patient as claimed in claim 36, further comprising means for removably securing said conveyor to said base.

38. An apparatus for transporting a patient as claimed in claim 37, wherein said means for removably securing said conveyor to said base comprises a tube and a post slidably received by said tube, wherein one of said post and said tube is secured to said base and the other of said post and said tube is secured to said conveyor.

39. A device for use with a base, a patient supporting member attached to the base and a sheet having a first end and a second end, said device comprising:

a roller having a first end and a second end extending in a longitudinal direction;

a sleeve slidably secured to said roller and movable in the longitudinal direction;

two bearing members, each bearing member adapted to be removably and rotatably secured to a respective one of said first end and said second end of said roller; and means for securing said roller and said sleeve to a sheet.

40. A device as claimed in claim 39, wherein said bearings are adapted to be releasably secured to the base.

41. A device as claimed in claim 39, wherein said means for securing said and said sheet to a sheet comprises a flexible strap.

42. A device as claimed in claim 41, wherein said flexible strap is releasably secured to at least one of said roller and said sleeve.

43. A device as claimed in claim 39, wherein said roller has a length in the longitudinal direction and said roller length in the longitudinal direction is adjustable.

44. A device as claimed in claim 43, wherein said roller comprises a first longitudinally extending member and a second longitudinally extending member slideably received by said first longitudinally extending member.

45. A method for transporting a patient to and from a bed having a mattress and a gurney having a patient supporting member, wherein a conveyor is attached to one of the bed and gurney, the conveyor including:

a) a roller having a length substantially equal to a length of said bed and said gurney extending in a longitudinal direction having a sleeve slidably received on the roller, said roller having a first end and a second end;

b) an attaching member for attaching said roller to said one of said bed and said gurney, said roller rotatably secured to said attaching member; and c) a rotating member attached to said roller for rotating said roller and said sleeve about the longitudinal axis passing through said roller, said method comprising the following steps:

(a) placing a sheet on one of said mattress of said bed and said patient supporting member of said gurney;

(b) positioning said patient on said sheet;

(c) attaching said conveyor to the other of said bed and said gurney having said sheet;

(d) positioning said gurney adjacent to said bed so that said conveyor is along a side of the other of said gurney and said bed, said side being furthest away from said one of said bed and said gurney having said sheet;

(e) removably attaching said sheet to said roller and said sleeve;

(f) rotating said roller and thereby winding the sheet around said roller and said sleeve;

(g) moving said patient on said sheet from said one of said bed and said gurney toward said roller onto the other of said bed and said gurney; and (h) removing said roller from said one of said bed and said gurney.

46. A method for transporting a patient as claimed in claim 45, wherein said conveyor further comprises a plurality of straps that extend along the length of said roller, said steps further comprise attaching said straps to said sheet, and adjusting the length of said straps after the patient begins to be moved on said sheet so that all of said straps are taut.

47. A method for transporting a patient as claimed in claim 45, wherein said roller has a length in the longitudinal direction and said roller length in the longitudinal direction is adjustable, said method further comprises the step of adjusting the length of said roller to a length substantially equal to a length of the bed and the gurney.

* * * * *

UNITED STATES PATENT AND TRADEMARK OFFICE

CERTIFICATE OF CORRECTION

PATENT NO. : 5,697,109
DATED : December 16, 1997
INVENTOR(S) : Graham L. Hodgetts It is certified that error appears in the above-identified patent and that said Letters Patent is hereby corrected as shown below:

Column 2 Line 57 after "flexible strip" delete period --.--.

Column 3 Line 5 after "positioning the patient" delete period --.--.

Column 5 Line 30 "member 58. member 58." should read --member 58.--.

Column 5 Line 48 after "is at least" delete period --.--.

Column 5 Line 58 "satisfactory" should read --satisfactorily--.

Column 6 Line 24 after "transferred" delete comma --,--.

Column 6 Line 46 after "moving patient" delete period --.--.

Column 8 Line 16 after "attached" delete period --.--.

Column 10 Line 24 "Each end portions" should read --Each end portion--.

Column 11 Line 15 after "are attached at" delete period --.--.

Column 11 Lines 58-59 "one in a half times" should read --one and a half times--.

Column 11 Line 66 after "directly" delete period --.--.

Column 12 Line 13 between "Straps" and "400" delete period --.--.

Column 12 Line 23 "prevents" should read --prevent--.

Column 14 Line 4 after "drawings" delete comma --,--.

UNITED STATES PATENT AND TRADEMARK OFFICE

CERTIFICATE OF CORRECTION

PATENT NO. : 5,697,109

DATED : December 16, 1997

INVENTOR(S) : Graham L. Hodgetts

It is certified that error appears in the above-identified patent and that said Letters Patent is hereby corrected as shown below:

Column 14 Line 28 between "other" and "and" delete comma --,--.

Column 15 Line 7 after "support" delete period --.--.

Column 15 Line 21 after "310 in" delete period --.--.

Column 17 Line 5 Claim 1, under (d), "pateint" should read --patient--.

Column 19 Line 47 Claim 41, after "securing said" insert --roller--.

Signed and Sealed this

Twenty-first Day of April, 1998

Bruce Lehman

*Attest:*

BRUCE LEHMAN

*Attesting Officer*

*Commissioner of Patents and Trademarks*